US012372325B2

(12) United States Patent
McCarthy et al.

(10) Patent No.: US 12,372,325 B2
(45) Date of Patent: Jul. 29, 2025

(54) ADJUSTABLE FIREARM BUTT ASSEMBLY

(71) Applicant: DAWSON ENTERPRISES SPORT SHOOTING SUPPLIES LLC, Massillon, OH (US)

(72) Inventors: Patrick McCarthy, Massillon, OH (US); Curtis Eldred Dutton, Canton, OH (US)

(73) Assignee: DAWSON ENTERPRISES SPORT SHOOTING SUPPLIES LLC, Massillon, OH (US)

( * ) Notice: Subject to any disclaimer, the term of this patent is extended or adjusted under 35 U.S.C. 154(b) by 0 days.

(21) Appl. No.: 18/617,039

(22) Filed: Mar. 26, 2024

(65) Prior Publication Data

US 2024/0328749 A1 Oct. 3, 2024

Related U.S. Application Data

(60) Provisional application No. 63/456,433, filed on Mar. 31, 2023.

(51) Int. Cl.
*F41C 23/14* (2006.01)
*F41C 23/08* (2006.01)

(52) U.S. Cl.
CPC ..... *F41C 23/14* (2013.01); *F41C 23/08* (2013.01)

(58) Field of Classification Search
CPC ..... F41C 23/14; F41C 23/08
See application file for complete search history.

(56) References Cited

U.S. PATENT DOCUMENTS 1,088,362 A * 2/1914 Perkins ..... F41C 23/14 42/73
1,331,074 A * 2/1920 Marble ..... F41C 23/20 42/74
2,187,548 A 1/1940 Smith
(Continued)

FOREIGN PATENT DOCUMENTS

DE 202011052542 U1 4/2012

OTHER PUBLICATIONS

PCT Search Report and Written Opinion for corresponding Application Serial No. PCT/US2024/021496 mailed Oct. 7, 2024, pp. 1-10.

*Primary Examiner* — Michelle Clement
(74) *Attorney, Agent, or Firm* — Tarolli, Sundheim, Covell & Tummino LLP

(57) ABSTRACT

An adjustable firearm butt assembly comprises a base plate selectively attached to a buttstock of a firearm. The base plate has a base slot. An adjustment nut is aligned with, and transversely movable relative to, the base slot. A pad plate is selectively attached to the base plate with the base plate being interposed longitudinally between the pad plate and the adjustment nut. The pad plate has a plate slot and a guide track. The plate slot is aligned with both the adjustment nut and the base slot. A guide pin has a portion selectively received in the guide track. An attachment fastener selectively extends through the plate slot and into engagement with the adjustment nut to selectively attach the pad plate to the base plate. The attachment fastener is laterally movable with respect to the plate slot. The attachment fastener is selectively movable between unclamped and clamped conditions.

20 Claims, 17 Drawing Sheets

(56) References Cited

U.S. PATENT DOCUMENTS

| | | | | |
|---|---|---|---|---|
| 5,009,021 | A * | 4/1991 | Nelson | F41C 23/14<br>42/73 |
| 7,536,819 | B2 | 5/2009 | Popikow | |
| 9,417,033 | B2 * | 8/2016 | Wood | F41C 23/20 |
| 10,488,150 | B1 * | 11/2019 | Slagel | F41C 23/08 |
| 2014/0109453 | A1 | 4/2014 | Paquette | |
| 2017/0131062 | A1 | 5/2017 | Wood et al. | |
| 2022/0299293 | A1 | 9/2022 | Mebberson | |

* cited by examiner

ADJUSTABLE FIREARM BUTT ASSEMBLY

RELATED APPLICATION

This application claims priority from U.S. Provisional Application No. 63/456,433, filed 31 Mar. 2023, the subject matter of which is incorporated herein by reference in its entirety.

TECHNICAL FIELD

This disclosure generally relates to an adjustable firearm butt assembly. This disclosure also generally relates to a method for customizing a firearm butt assembly for a user of a firearm.

BACKGROUND

Firearm butt assemblies that are adjustable relative to their corresponding buttstocks are known. Adjustment of a typical firearm butt assembly includes loosening a single adjustment screw, adjusting a portion of the firearm butt assembly to a desired relative to the buttstock, and then tightening the single adjustment screw to maintain the firearm butt assembly in the desired orientation. The firearm butt assembly thus is maintained in its desired orientation only via the tightened single adjustment screw. Having only one mechanism/element for substantially preventing an unwanted adjustment of the firearm butt assembly may be undesirable in certain use conditions.

SUMMARY

In an aspect, alone or in combination with any other aspect, an adjustable firearm butt assembly comprises a base plate selectively attached to a buttstock of a firearm. The base plate has a base slot. An adjustment nut is aligned with, and transversely movable relative to, the base slot. A pad plate is selectively attached to the base plate with the base plate being interposed longitudinally between the pad plate and the adjustment nut. The pad plate has a plate slot and a guide track. The plate slot is aligned with both the adjustment nut and the base slot. A guide pin has a portion selectively received in the guide track. An attachment fastener selectively extends through the plate slot and into engagement with the adjustment nut to selectively attach the pad plate to the base plate. The attachment fastener is laterally movable with respect to the plate slot. The attachment fastener is selectively movable between unclamped and clamped conditions via engagement with the adjustment nut. The pad plate is selectively movable relative to the base plate and the guide pin when the attachment fastener is in the unclamped condition. The guide pin slides along the guide track responsive to movement of the pad plate relative to the base plate and the guide pin. The pad plate is substantially prevented from moving relative to the base plate when the attachment fastener is in the clamped condition. Contact between the guide pin and a track wall of the guide track at least partially restricts the movement of the pad plate relative to the base plate when the attachment fastener is in the clamped condition.

In an aspect, alone or in combination with any other aspect, a method for customizing a firearm butt assembly for a user of a firearm comprises providing an adjustable firearm butt assembly. The assembly is attached to the buttstock of the firearm. With the adjustment fastener in the unclamped condition, the pad plate is moved relative to the base plate to place the pad plate in a predetermined orientation. The guide pin slides along the guide track as the pad plate moves relative to the base plate. With the pad plate in the predetermined orientation, the adjustment fastener is manipulated to the clamped condition to substantially prevent the pad plate from moving relative to the base plate from the predetermined orientation. Contact between the guide pin and the track wall of the guide track at least partially restricts the movement of the pad plate relative to the base plate when the attachment fastener is in the clamped condition.

BRIEF DESCRIPTION OF THE DRAWINGS

The foregoing and other features of the present disclosure will become apparent to those skilled in the art to which the present disclosure relates upon reading the following description with reference to the accompanying drawings, in which:

FIGS. 12A-10E illustrate an example sequence of operation of the assembly of FIG. 1;

DESCRIPTION OF EMBODIMENTS

Unless defined otherwise, all technical and scientific terms used herein have the same meaning as is commonly understood by one of ordinary skill in the art to which the present disclosure pertains.

As used herein, the term "user" can be used interchangeably to refer to an individual who prepares for, assists with, and/or performs the operation of a tool.

As used herein, the singular forms "a," "an" and "the" can include the plural forms as well, unless the context clearly indicates otherwise. It will be further understood that the terms "comprises" and/or "comprising," as used herein, can specify the presence of stated features, steps, operations, elements, and/or components, but do not preclude the presence or addition of one or more other features, steps, operations, elements, components, and/or groups thereof.

As used herein, the term "and/or" can include any and all combinations of one or more of the associated listed items.

As used herein, phrases such as "between X and Y" and "between about X and Y" can be interpreted to include X and Y.

As used herein, the phrase "at least one of X and Y" can be interpreted to include X, Y, or a combination of X and Y. For example, if an element is described as having at least one of X and Y, the element may, at a particular time, include X, Y, or a combination of X and Y, the selection of which could vary from time to time. In contrast, the phrase "at least one of X" can be interpreted to include one or more Xs.

It will be understood that when an element is referred to as being "on," "attached" to, "coupled" with, "contacting," etc., another element, it can be directly on, attached to, coupled with or contacting the other element or intervening elements may also be present. It will also be appreciated by those of skill in the art that references to a structure or feature that is disposed "adjacent" another feature may not have portions that overlap or underlie the adjacent feature.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or Figures unless specifically indicated otherwise.

The invention comprises, consists of, or consists essentially of the following features, in any combination.

Figure 1:
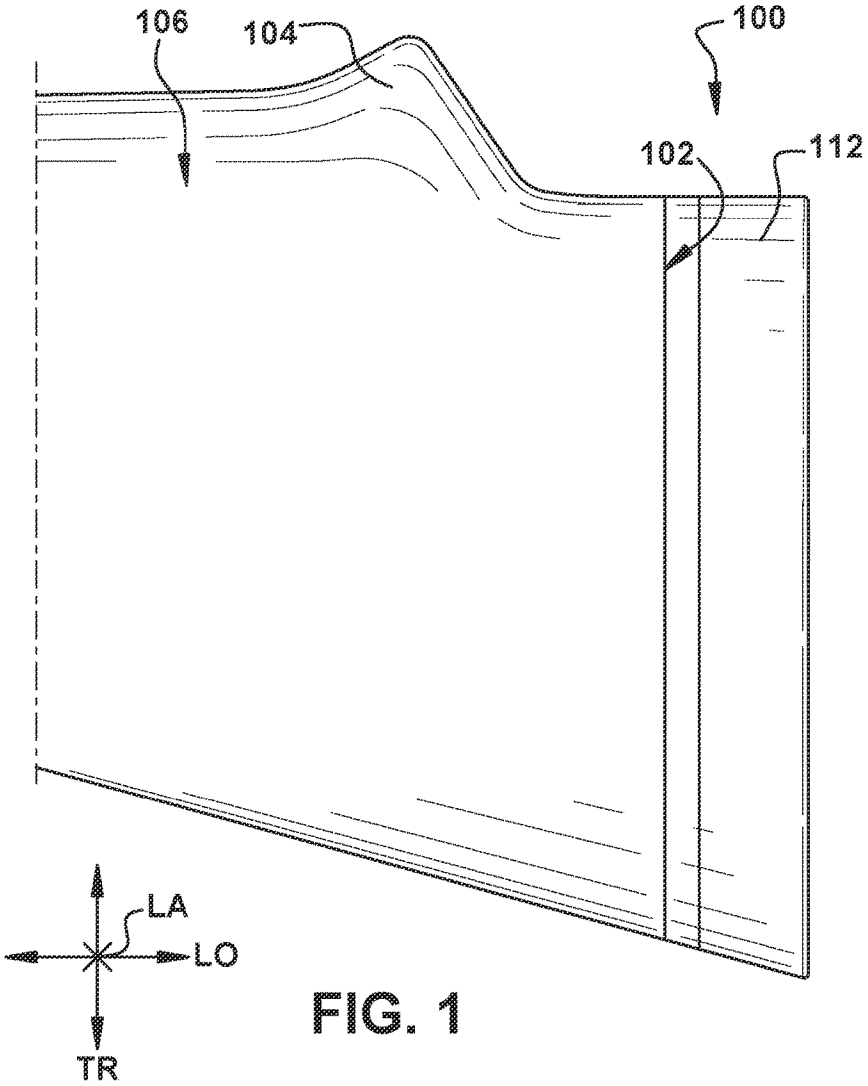
FIG. 1 is a side view of an adjustable firearm butt assembly according to an aspect of the present disclosure, depicting the adjustable firearm butt assembly in an example use environment.

FIG. 1 depicts an example adjustable firearm butt assembly 100 selectively attached to a buttstock 104 of a firearm 106 on or adjacent to a longitudinal end surface 102 of the buttstock 104. The term "longitudinal" is used herein to indicate a substantially horizontal direction, in the orientation of FIG. 1, and is indicated as "LO" in the Figures. As shown in FIGS. 1-4B, the assembly 100 includes a base plate 208, a spring plate 409, a pad plate 310, and a pad 112, all of which may correspond to each other and/or to the buttstock 104 in one or more of size, footprint, cross-sectional profile, and shape. Furthermore, at least one of the base plate 208, the spring plate 409, the pad plate 310, the pad 112, and any other component of the assembly 100 may optionally be a similar color to, or otherwise have colors/materials chosen for aesthetic reasons based at least partially on, finish colors/materials of the buttstock 104 and/or the firearm 106 as a whole.

The assembly 100 also includes a plurality of attachment fasteners 414*a-f* for coupling portions of the assembly 100 to one another and for mounting the assembly 100 to the buttstock 104. Furthermore, the assembly 100 includes a guide pin 216, an adjustment nut 218, and an adjustment fastener 322. The guide pin 216, the adjustment nut 218, and the adjustment fastener 222 allow a user to selectively adjust and customize the location and orientation of the pad plate 310 and the pad 112 relative to the base plate 208, the spring plate 409, and the buttstock 104, thereby increasing the surface area of the pad 112 in contact with the user and improving the flushness of the pad 112 against the user. This allows the user to select a custom and comfortable interface (e.g., of the user's shoulder) with the firearm 106.

Figure 4A:
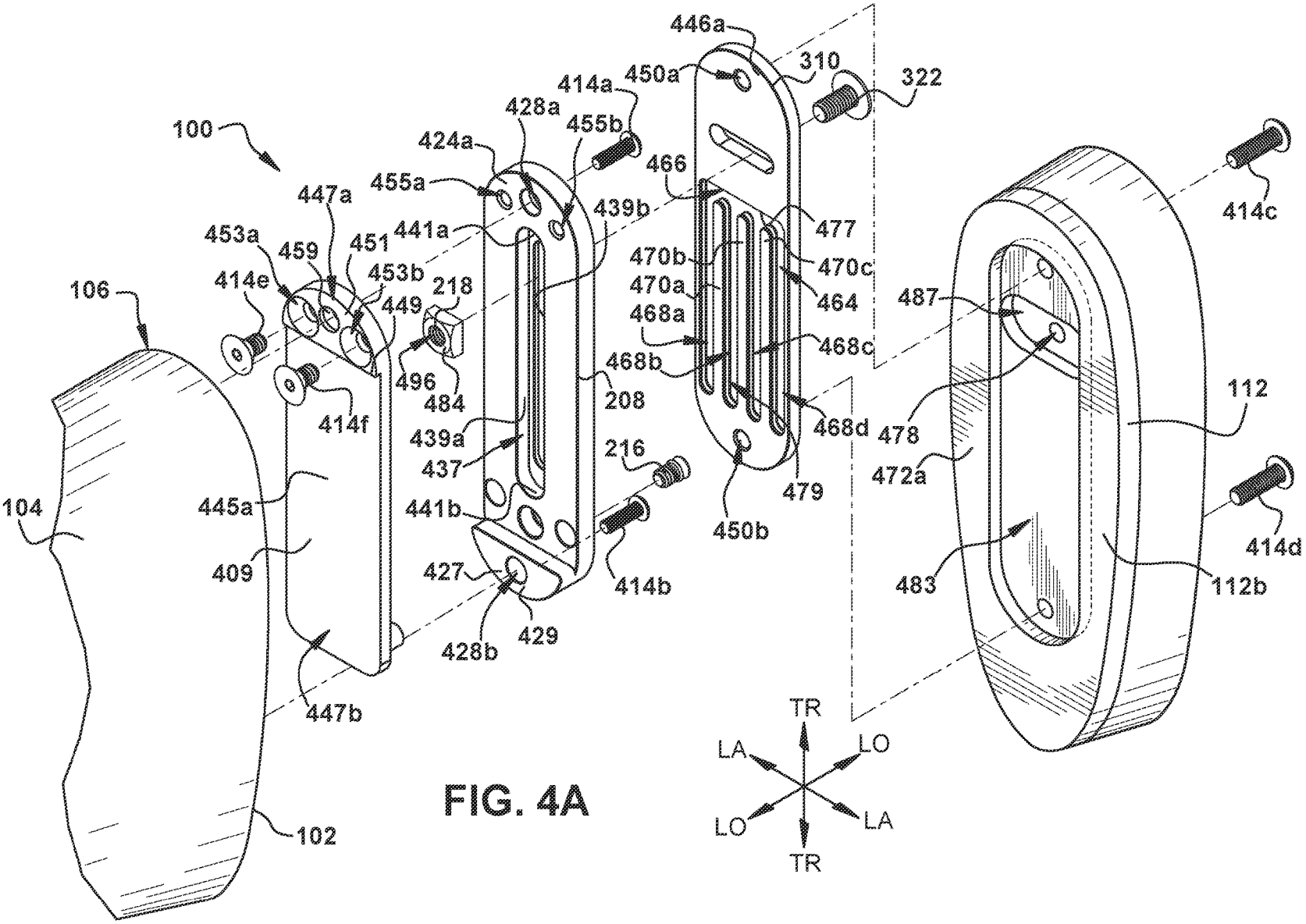
FIG. 4A is a partially exploded perspective front view of the assembly of FIG. 1.
Figure 4B:
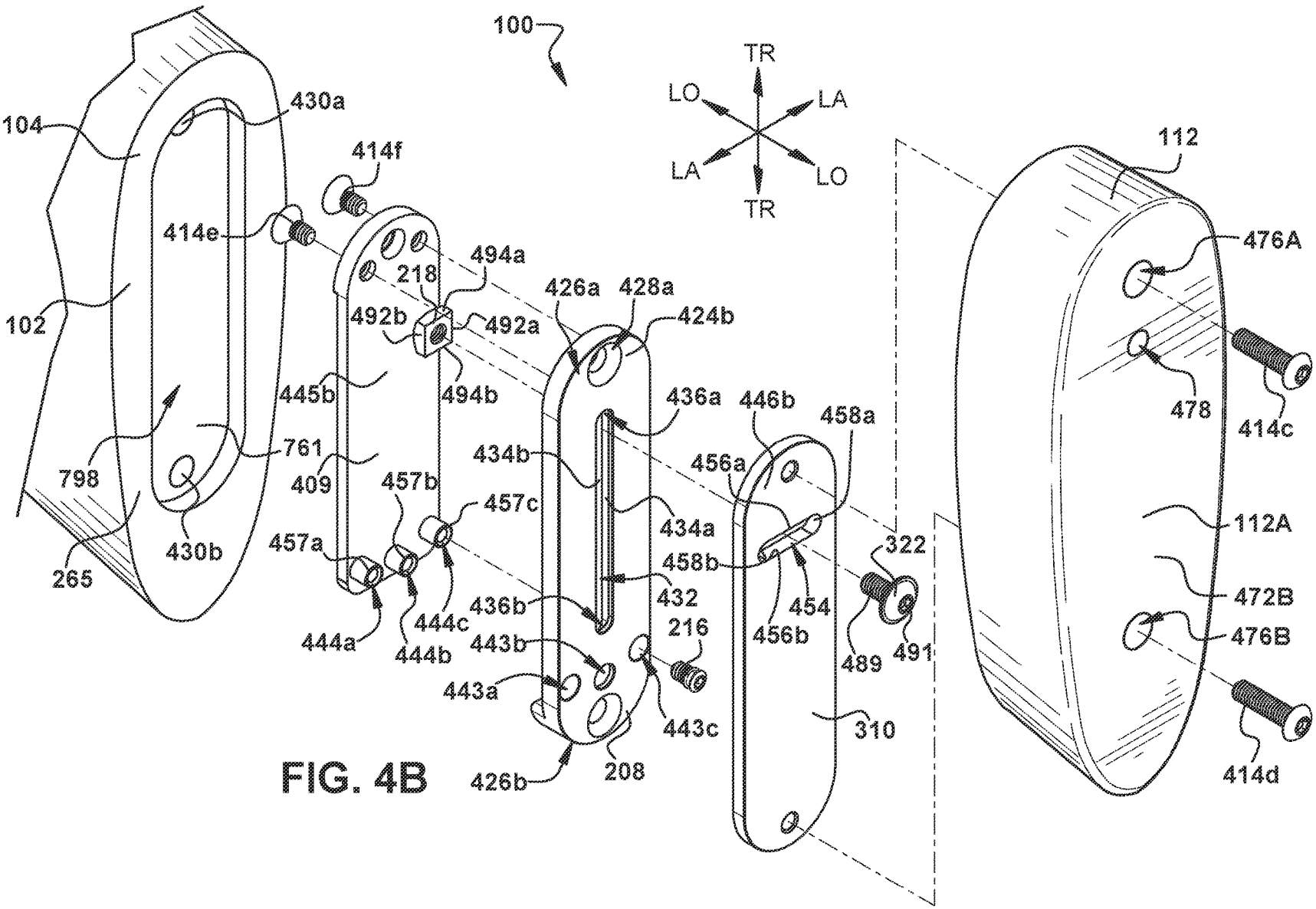
FIG. 4B is a partially exploded perspective rear view of the assembly of FIG. 1.
Figure 6:
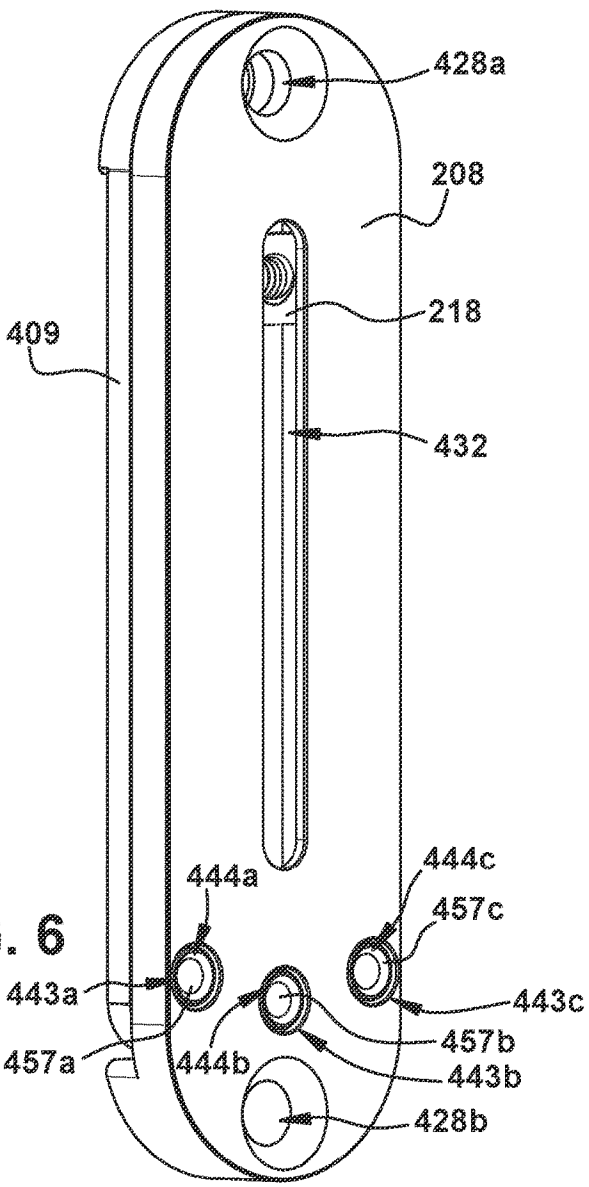
FIG. 6 is a perspective rear view of a portion of the assembly of FIG. 1.

As shown in FIGS. 4A-4B, the base plate 208 has a front face 424*a* (shown in FIG. 4A) and a longitudinally opposite rear face 424*b* (shown in FIG. 4B). The base plate 208 also has transversely spaced first and second base ends 426*a*, 426*b*. The term "transverse" is used herein to indicate a direction substantially perpendicular to the "longitudinal" direction, is shown as a substantially vertical direction, in the orientation of FIGS. 4A-4B, and is indicated as "TR" in the Figures. A first foot 427 of the base plate 208 is located at the second base end 426*b* and extends longitudinally from the front face 424*a* to a first free foot end 429.

The base plate 208 includes first and second attachment holes 428*a*, 428*b* of the base plate 208 extending longitudinally through the entirety of the base plate 208. The first and second attachment holes 428*a*, 428*b* are spaced transversely from one another on the base plate 208, with the first attachment hole 428*a* being located at the first base end 426*a* and the second attachment hole 428*b* being located at the second base end 426*b*. The second attachment hole 428*b* is positioned such that it extends longitudinally from the rear face 424*b* to the first free foot end 429, and thus the second attachment hole 428*b* extends through the entirety of the first foot 427 too. However, the base plate 208 may be configured such that the second attachment hole 428*b* is spaced transversely from the first foot 427.

The base plate 108 also includes a base slot 432 extending entirely longitudinally therethrough. The base slot 432 may be located transversely between the first and second attachment holes 428*a*, 428*b* and the first and second base ends 426*a*, 426*b*. The base slot 432 is elongate and has a longest dimension oriented in the transverse direction. The base slot 432 may have parallel, substantially straight lateral sides 434*a*, 434*b* that are flanked by two semi-circular transverse ends 436*a*, 436*b*, though the base slot 432 may have any other desired shape. The term "lateral" is used herein to indicate a direction substantially perpendicular to both the "longitudinal" and "transverse" directions, and is indicated as "LA" in the Figures.

As shown in FIG. 4A, the base plate 208 may include a base depression 437 formed into the front face 424*a* of the base plate 208 around the base slot 432. Unlike the base slot 432, the base depression is a blind recess extending slightly into the front face 424*a* only. The base depression 437 surrounds the base slot 432 and, like the base slot 432, has a longest dimension oriented in the transverse direction. The base depression 437 may correspond to the shape of the base slot 432. Therefore, as depicted in FIG. 4A, the base depression 437 may be defined by parallel, substantially straight lateral sides 439*a*, 439*b* that are flanked by two semi-circular transverse ends 441*a*, 441*b*. Although the shape of the base depression is depicted 437 as corresponding to that of the base slot 432, the base depression may have any other desired shape.

As shown in FIGS. 4A-B, the base plate 208 has a plurality of projection apertures 443*a-c* extending longitudinally through the entirety of the base plate 208, though the base plate 208 may be configured to have only one projection aperture extending therethrough.

Referring to FIGS. 4A-6, the spring plate 409 is securable to the front face 426*a* of the base plate 208. The spring plate 409 has a front face 445*a* (shown in FIGS. 4A and 5) and an opposed rear face 445*b* (shown in FIG. 4B). The shape of the spring plate 409 may at least partially correspond to the shape of the base plate 208 so that the spring plate 409 may, in certain orientations, comprise a contiguous extension of the base plate 208 when secured thereto. The spring plate 409 and/or the base plate 208 may be at least partially formed from an elastically deformable material or combination of materials, such as metal and/or high-density plastic.

The spring plate 409 has transversely spaced first and second spring ends 447*a*, 447*b*. A second foot 449 of the spring plate 409 is located at the first spring end 447*a* and extends longitudinally from the front face 445*a* to a second free foot end 451. First and second securing holes 453*a*, 453*b* extend longitudinally through the entirety of the spring plate 409 (including the second foot 449) at the first spring end 447*a*. Therefore, the first and second securing holes 453*a*, 453*b* extend from the rear face 445*b* of the spring plate 409 to the second free foot end 451. The spring plate 409, however, may be configured such that the first and second securing holes 453*a*, 453*b* are spaced transversely from the second foot 449.

The spring plate 409 may be selectively secured to the front face 426*a* of the base plate 208 (e.g., at the first base end 426*a*) via the attachment fasteners 414*e*, 414*f* that extend through the first and second securing holes 453*a*, 453*b* and into corresponding first and second securing bores 455*a*, 455*b* in the front face 424*a* of the base plate 208. The attachment fasteners 414*e*, 414*f* may be, for example, threaded bolts or screws and the first and second securing bores 455*a*, 455*b* may be threaded so that the attachment fasteners 414*e*, 414*f* may be threadably engaged with the first and second securing bores 455*a*, 455*b*. The first and second securing holes 453*a*, 453*b* may be countersunk on the front face 445*a* to accept the enlarged heads of the attachment fasteners 414*e*, 414*f* so as to lie substantially flush with, or recessed slightly into, the front face 445*a* when the attachment fasteners 414*e*, 414*f* are fully engaged in the first and second securing holes 453*a*, 453*b*.

Although the assembly 100 is depicted in the Figures as having two securing holes 453*a*, 453*b* and two securing bores 455*a*, 455*b*, the assembly 100 may include any desired number of securing holes and bores 453*a*, 453*b*, 455*a*, 455*b*, and need not include the same number of both. Furthermore, although the securing bores 455*a*, 455*b* are depicted as being "blind" bores that extend only partially into the front face 426*a* of the base plate 208, it is contemplated that the securing bores 455*a*, 455*b* may instead be configured to extend entirely longitudinally through the base plate 208.

Figure 5:
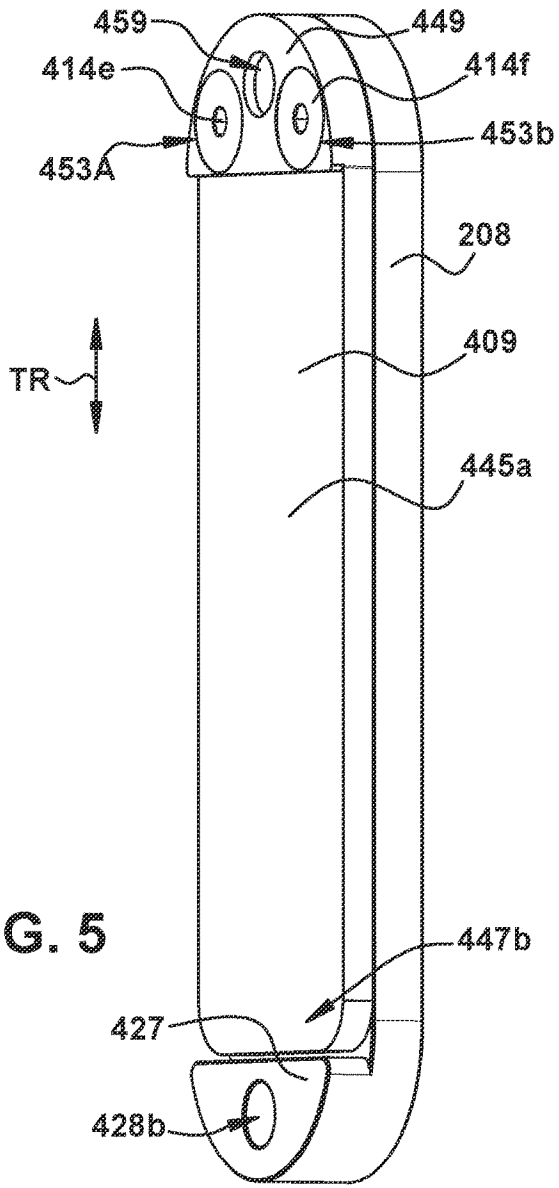
FIG. 5 is a partial perspective front view of the assembly of FIG. 1.

It should be appreciated that the second spring end 447*b* is not secured directly to the base plate 208. In this configuration, e.g., only the first spring end 447*a* of the spring plate 409 is secured to the base plate 208. Such an arrangement permits the second spring end 447*b* to selectively pivot in the longitudinal direction relative to the first spring end 447*a* and the base plate 208 when the spring plate 409 is secured to the base plate 208. Furthermore, as shown in FIG. 5, although the spring plate 409 at least partially corresponds to the shape of the base plate 208, a transverse height of the spring plate 409 is less than that of the base plate 208. Therefore, when the spring plate 409 is joined to the base plate 208, the second spring end 447*b* is transversely adjacent to the first foot 427, but does not longitudinally overlie the first free foot end 429. Such an arrangement helps achieve a relatively longitudinally compact footprint for the combined base and spring plates 208, 409. The second spring end 447*b* of the spring plate 409, although transversely adjacent to the first foot 427, is at least partially spaced from the first foot 427 in the transverse direction. Such transverse spacing further promotes the spring plate's 409 ability to pivot. However, in certain configurations of the assembly 100, the second spring end 447*b* may be configured to loosely contact the first foot 427 in the transverse direction without significantly hindering the ability of the spring plate 409 to be pivoted.

Returning to FIGS. 4A-6, the spring plate 409 includes a plurality of pin projections 457*a-c* extending longitudinally from the rear face 445*b* of the spring plate 409. Although the spring plate 409 is shown as having three pin projections 457*a-c*, the spring plate 409 may have any desired number of pin projections 457*a-c* (i.e., one or more pin projections 457*a-c*). Each pin projection 457*a-c* includes a pin aperture 444*a-c* formed therein. Each pin aperture 444*a-c* is a blind recess extending slightly longitudinally into a respective pin projection 457*a-c* only. However, it is contemplated that at least one of the pin apertures 444*a-c* may instead be configured to extend entirely longitudinally through its respective pin projection 457*a-c* and the spring plate 409.

The pin projections 457*a-c* extend longitudinally into corresponding projection apertures 443*a-c* of the base plate 208 when the spring plate 409 is secured to the base plate 208. The number of pin projections 456*a-c* and projection apertures 443*a-c* thus may directly correspond to one another, in some use environments. The pin projections 457*a-c* fit in the projection apertures 443*a-c* is configured to permit the selective pivoting of the spring plate 409 relative to the base plate 208. Therefore, the pin projections 457*a-c* move longitudinally in the projection apertures 443*a-c* relative to the base plate 208 with the longitudinally pivoting second spring end 447*b*.

The spring plate 409 also includes an attachment hole 459 extending longitudinally through the entirety of the spring plate 409 at the first spring end 447*a*. The attachment hole 459 is positioned to extend longitudinally from the rear face 445*b* to the second free foot end 451, and thus the attachment hole 459 of the spring plate 409 extends through the entirety of the second foot 449 too. However, the spring plate 409 may be configured with the attachment hole 459 spaced transversely from the second foot 449. The attachment hole 459, however, is located coaxially with the first attachment hole 428*a* of the base plate 208 when the spring plate 409 is secured to the base plate 208.

Figure 7:
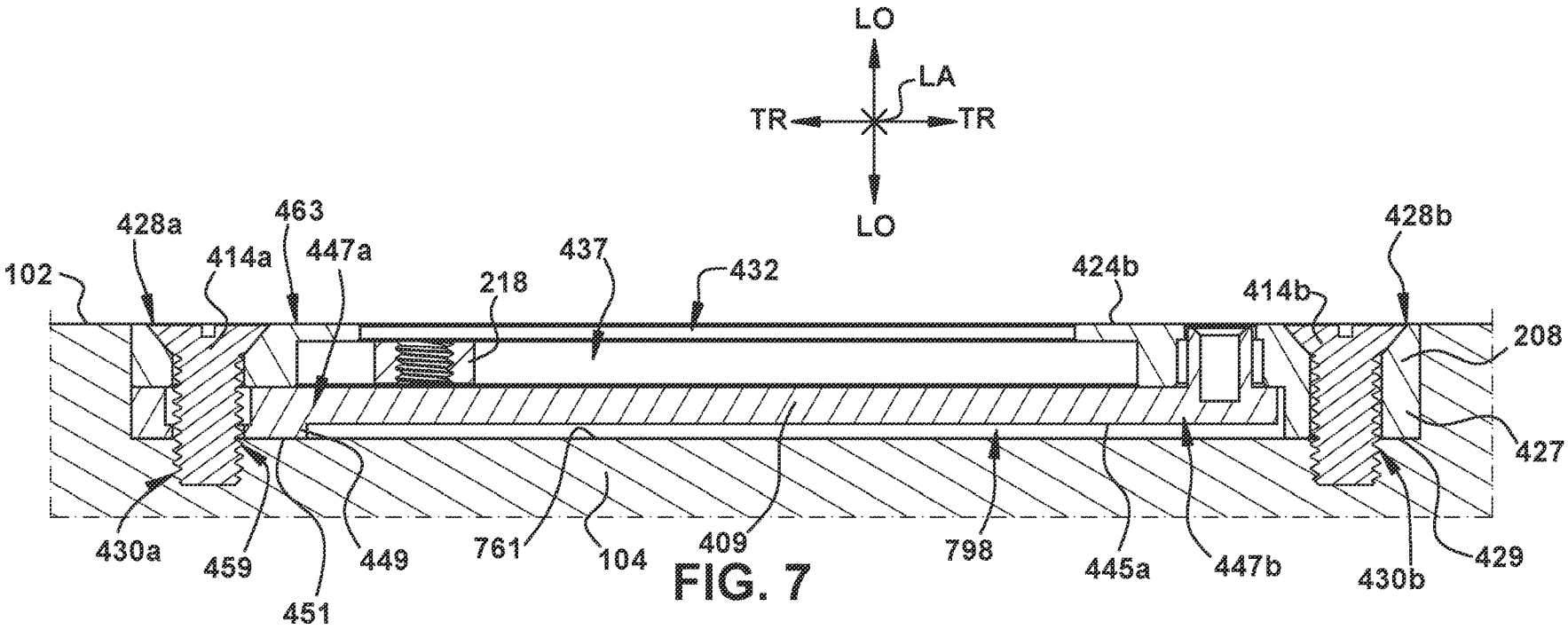
FIG. 7 is a partial cross-sectional view of the assembly of FIG. 1, including the assembly in a first condition.

As shown in FIG. 7, once the spring plate 409 has been secured to the base plate 208, the combined base and spring plates 208, 409 may be selectively fixed to the buttstock 104 adjacent the longitudinal end surface 102 thereof. In particular, the spring plate 409 and the base plate 208 may be inserted at least partially into a correspondingly shaped buttstock depression 798. The buttstock depression 798 may be formed in the longitudinal end surface 102 of the buttstock 104 and may extend longitudinally inward into the buttstock 104 from the longitudinal end surface 102.

The inserted base and spring plates 208, 409 may be selectively fixed to the buttstock 104 via the attachment fastener 414*a* extending through the first attachment hole 428*a* of the base plate 208 and the attachment hole 459 of the spring plate 409 and into a corresponding first bore 430*a* in a longitudinally facing depression end surface 761 of the buttstock 104. Similarly, an attachment fastener 414*b* extends through the second attachment hole 428*b* of the base plate 208 and into a corresponding second bore 430*b* in the depression end surface 761. The attachment fasteners 414*a*, 414*b* may be, for example, threaded bolts or screws and the first and second bores 430*a*, 430*b* may be threaded so that the attachment fasteners 414*a*, 414*b* may be threadably engaged with the first and second bores 430*a*, 430*b*. The first and second attachment holes 428*a*, 428*b* of the base plate 208 may be countersunk on the rear face 424*b* to accept the enlarged heads of the attachment fasteners 414*a*, 414*b* so that the attachment fasteners 414*a*, 414*b* lie substantially flush with, or recessed slightly into, the rear face 424*b* when the attachment fasteners 414*a*, 414*b* are fully engaged in the first and second attachment holes 428*a*, 428*b*.

When inserted, the spring plate 409 is interposed longitudinally between the base plate 208 and the depression end surface 761 and the first and second free foot ends 429, 451 each directly contact the depression end surface 761. A longitudinal length of the combined base and spring plates 208, 409 transversely between the first and second feet 427, 449 (i.e., interposed transversely between, but not including, the first and second feet 427, 449) is less than a longitudinal length of the combined base and spring plates 208, 409 at each of the first and second feet 427, 449 when the spring plate 409 is in an unflexed condition. As used herein an "unflexed" condition is a condition in which the spring plate 409 extends substantially straightly in the transverse direction without significant bends in the spring plate 409 between the first and second spring ends 447*a*, 447*b*. This arrangement results in at least the second spring end 447*b* of the unflexed spring plate 409 (i.e., the front face 445*a* of the unflexed spring plate 409 located at least at the second spring end 447*b*) being spaced from the depression end surface 761. The spacing (i.e., the longitudinal distance) between the second spring end 447*b* of the unflexed spring plate 409 and the depression end surface 761 not only permits the second spring end 447*b* to be pivoted longitudinally, this spacing also defines the maximum extent at which the second spring end 447*b* may be pivoted longitudinally toward the depression end surface 461 since the second spring end 447*b* can be pivoted longitudinally toward the depression end surface 461 until the second spring end 447*b* (e.g., the front face 455*a* at the second spring end 447*b*) makes contact with the depression end surface 761.

As shown in FIG. 7, the rear face 424*b* of the inserted base plate 208 may form a single continuous surface 763 in conjunction with the longitudinal end surface 102 of the buttstock 104, though at least the insert base plate 108 may be configured to extend longitudinally outward beyond the longitudinal end surface 102 and/or to at least partially cover a portion of the longitudinal end surface 102. As another alternative, the longitudinal end surface 102 may include a separate buttstock cover 265 (e.g., a plastic, metal, and/or rubber cover) attached thereto, such as in the arrangement shown by way of example in FIG. 2. When a buttstock cover 265 is provided, the rear face 424*b* of the inserted base plate 208 may form the single continuous surface 763 with the buttstock cover 265 and/or the longitudinal end face 102 of the buttstock 104.

Although the base plate 208 and the spring plate 409 are depicted as being selectively inserted into the buttstock depression 798, at least one of the base and spring plates 208, 409 may be external to the buttstock depression 798, such as by being located on or adjacent to the longitudinal end surface 102. Furthermore, although the base and spring plates 208, 409 have been shown as being selectively maintained in engagement with the buttstock depression 798 via the attachment fasteners 414*a*, 414*b*, the base and spring plates 208, 409 may instead, or additionally, be selectively or substantially permanently maintained within the buttstock depression 798 via a press-fit or frictional engagement or any other suitable engagement mechanism.

Returning to FIGS. 2-6, the guide pin 216 may be selectively inserted into a selected one of the pin apertures 444*a-c*. The guide pin 216 is shown as being substantially circular in cross-section, though the guide pin 216 may have any other desired cross-sectional shape, such as, e.g., curvilinear, rectilinear, curved, triangular, square, and/or ovoid. For example, the shape of the guide pin 216 may be selected to correspond to the shape of the pin apertures 444*a-c*. It is contemplated that the guide pin 216 may exhibit differing cross-sectional shapes along a length thereof.

Figure 8:
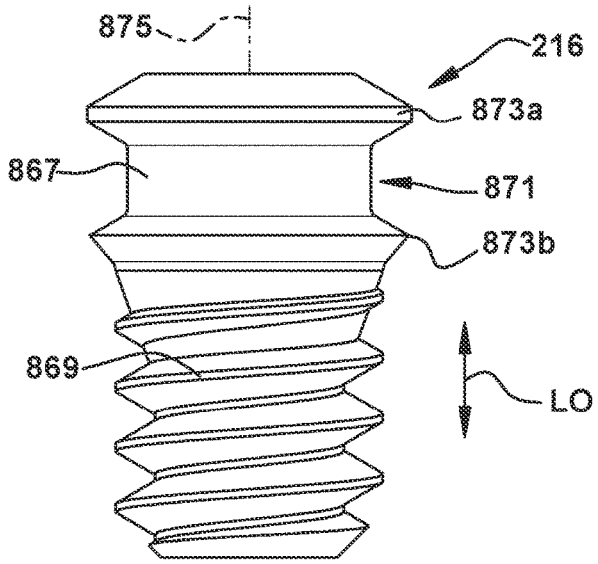
FIG. 8 is a partial side view of the assembly of FIG. 1.

As shown in FIG. 8, the guide pin 216 may a guide head 867 and a guide shank 869 extending longitudinally from the guide head 867. The guide head 867 includes a head groove 871 (e.g., an annular head groove 871) interposed between and defining first and second head projecting portions 873*a*, 873*b*, though it is contemplated that the guide head 867 may include only the first head projecting portion 873*a* (i.e., the head projecting portion longitudinally opposite the guide shank 869). The first and second head projecting portions 873*a*, 873*b* thus extend further outward from a longitudinally extending central guide axis 875 of the guide pin 216 than the head groove 871.

Figure 9:
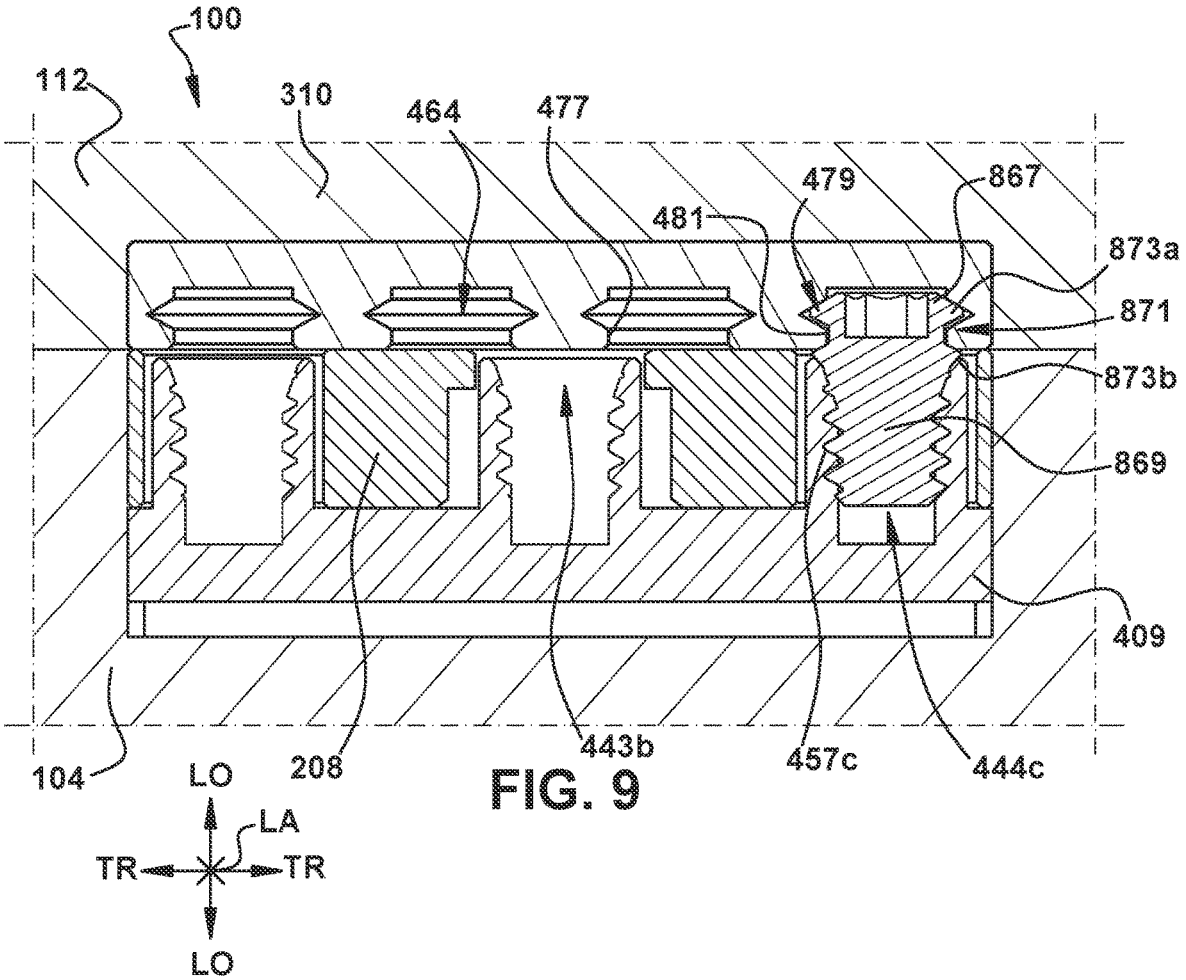
FIG. 9 is a cross-sectional view taken along line 9-9 of FIG. 1.

The guide shank 869 and pin apertures 444*a-c* may be threaded so that the guide shank 869 may be threadably engaged with a selected one of the pin apertures 444*a-c*. Such a threaded engagement may help prevent the guide pin 216 from being undesirably removed from the pin aperture 444*a-c* in which the guide pin 216 is inserted. Furthermore, as shown in FIG. 9, the guide pin 216 and/or the pin apertures 444*a-c* are configured such that when the guide shank 869 is inserted into a selected one of the pin apertures 444*a-c*, at least the guide head 867 extends longitudinally outward from the selected pin aperture 444*a-c*. The guide pin 216 may be at least partially formed from a strong, rugged, durable material or combination of materials, such as metal and/or high-density plastic.

Although the guide shank 869 is shown in the Figures as being threadably engaged to a selected one of the pin apertures 444*a-c*, the guide shank 869 and/or the pin apertures 444*a-c* may be configured to provide any other type of suitable engagement therebetween, such as, e.g., a press-fit or frictional-fit engagement.

Figure 3:
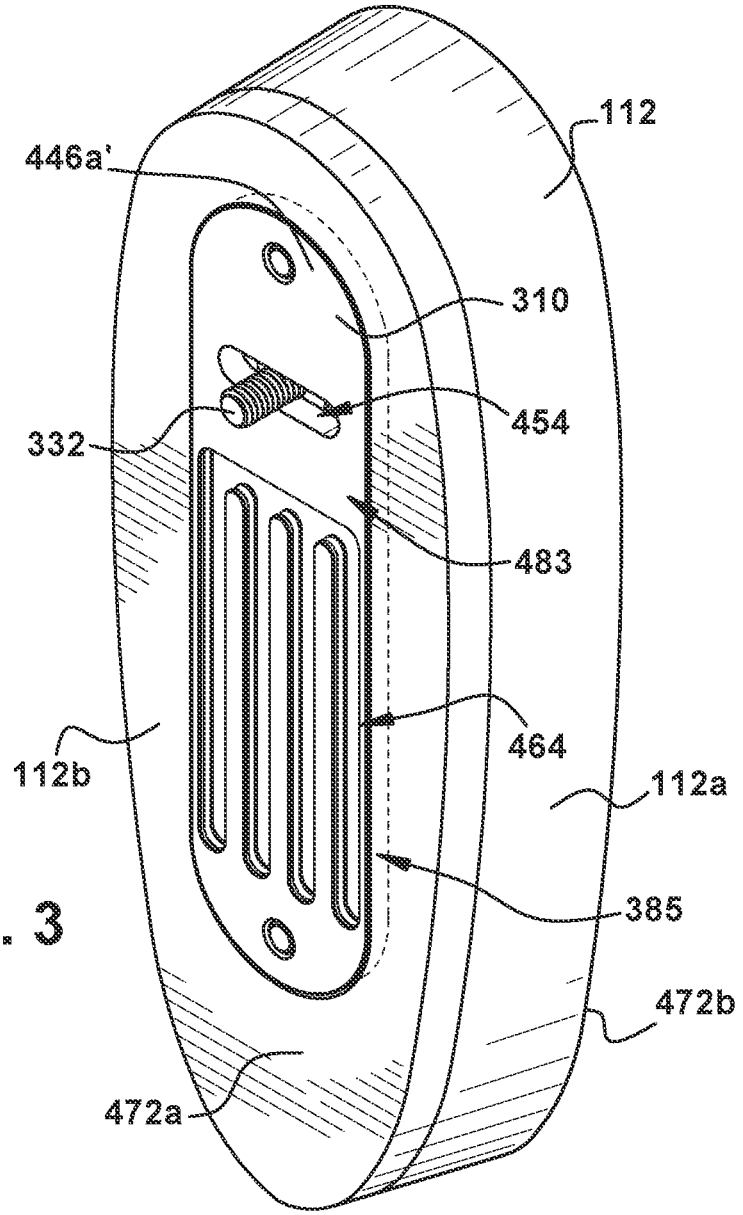
FIG. 3 is a partial perspective front view of the assembly of FIG. 1.

Referring now to FIGS. 3-4B, the pad plate 310 is mountable to the base plate 108. The pad plate 110 has a front face 446*a* (shown in FIG. 4A) and a longitudinally opposed front face 446*b* (shown in FIG. 4B). The shape of the pad plate 310 may correspond to the shape of the base plate 208 so that the pad plate 310 may, in certain orientations, comprise a contiguous extension of the base plate 208 when mounted thereto. The pad plate 310 may be at least partially formed from a strong, rugged, durable material or combination of materials, such as metal and/or high-density plastic.

The pad plate 310 includes first and second attachment holes 450*a*, 450*b* extending longitudinally through the entirety of the pad plate 310. The first and second attachment holes 450*a*, 450*b* are spaced transversely from one another on the pad plate 310.

The pad plate 310 includes a plate slot 454 extending entirely longitudinally therethrough. The plate slot 454 may be located transversely between the first and second attachment holes 450*a*, 450*b* of the pad plate 310. The plate slot 454 is elongate and has a longest dimension oriented along the lateral dimension. The plate slot 454 may have parallel, substantially straight transverse sides 456*a*, 456*b* that are flanked by two semi-circular lateral ends 458*a*, 458*b*, though the plate slot 454 may have any other desired shape for a particular use environment of the assembly 100.

As shown in FIG. 4A, a guide track 464 is recessed into the front face 446*a* of the pad plate 310 so that the guide track 464 is at least partially defined by a longitudinally extending track wall 477. The guide track 464 may extend transversely between the plate slot 454 and the second attachment hole 450*b*. In the example configuration shown in FIG. 4A, the guide track 464 includes a lateral guide track portion 466 and a plurality of transverse guide track portions 468*a-d* extending transversely from the lateral guide track portion 466 such that all the transverse guide track portions 468*a-d* are in mutual fluid communication via the lateral guide track portion 466. The transverse guide track portions 468*a-d* are at least partially defined by guide ribs 470*a-c*. These guide ribs 470 also separate the transverse guide track portions 468*a-d* from one another in the lateral direction. Although the guide track 464 is shown as having four transverse guide track portions 468*a-d*, the guiding track 464 may have only one or any other desired number of transverse guide track portions 468*a-d*. Furthermore, instead of having only a single lateral guide track portion 466, the guide track 464 may be configured to have no lateral guide track portion 466 (when the guide track 464 includes only one transverse guide track portion 468*a-d*) or a plurality of lateral guide track portions 466.

As shown in FIGS. 4A and 9, the track wall 477 may include a track groove 479 along the entirety of the track wall 477 for receiving the first head projecting portion 873*a* of the guide pin 216. A track projecting portion 981, which is at least partially defined by the track groove 479 and longitudinally adjacent to the front face 446*a*, may be configured to be at least partially received in the head groove 871 of the guide pin 216.

Referring now to FIGS. 3-4B, the pad 112 may be a resilient pad which at least partially absorbs and mitigates recoil forces of the firearm 106 during use. The pad 112 includes a front face 472*a* (shown in FIG. 2A) and a longitudinally opposed rear face 472*b* (shown in FIG. 4B). The pad 112 may be wholly or at least partially formed from an elastomeric or other material or combination of materials having desired properties of resiliency, durability, softness, and shape memory. For example, the pad 112 may have an elastomeric portion 112*a* for absorbing and mitigating recoil forces, and an at least partially rigid portion 112*b* for interfacing with the pad plate 310. The at least partially rigid portion 112*b*, when present, may be at least partially formed from rubber, plastic, metal, any other at least partially rigid material, or any combination thereof. The rear face 472*b* may be on the elastomeric portion 112*a*, while the front face 474*a* may be on the at least partially rigid portion 112*b*.

The pad plate 310 may be selectively fixed to pad 112 adjacent the front face 472*a* of the pad 112. In particular, the pad plate 310 may be inserted at least partially into a correspondingly shaped pad depression 483. The pad depression 483 may be formed in the front face 472*a* of the pad 112 and may extend longitudinally inward into the pad 112 from the front face 472*a*. The pad depression 483 thus may be formed in the at least partially rigid portion 112*b* of the pad 112 and may extend longitudinally toward the rear end face 272*b* of the pad 112.

The pad plate 310 may be selectively fixed to the pad 112 via the attachment fasteners 414*c*, 414*d* that extend through first and second attachment holes 476*a*, 476*b* of the pad 112 and into corresponding first and second attachment holes 450*a*, 450*b* of the pad plate 310. In this configuration, the first and second attachment holes 476*a*, 476*b* of the pad 112 extend longitudinally through the entirety of the pad 112 and are spaced transversely from one another on the pad 112. The attachment fasteners 414*c*, 414*d* may be, for example, threaded bolts or screws and the first and second attachment holes 450*a*, 450*b* of the pad plate 310 may be threaded so that the attachment fasteners 414*c*, 414*d* may be threadably engaged with the first and second attachment holes 450*a*, 450*b*.

In an alternate configuration, the first and second attachment holes 476*a*, 476*b* of the pad 112 may be configured as "blind" bores that extend only partially into the front face 472*a* of the pad 112. In such a configuration, the attachment fasteners 414*c*, 414*d* may extend through first and second attachment holes 450*a*, 450*b* of the pad plate 310 and into the corresponding first and second attachment holes 476*a*, 476*b* of the pad 112. Furthermore, the first and second attachment holes 476*a*, 476*b* of the pad 112 may be threaded so that the attachment fasteners 414*c*, 414*d* may be threadably engaged with the first and second attachment holes 450*a*, 450*b*. Lastly, the first and second attachment holes 450*a*, 450*b* of the pad plate 310 may be countersunk on the front face 446*a* to accept the enlarged heads of the attachment fasteners 214*c*, 214*d* so as to lie substantially flush with, or recessed slightly into, the front face 446*a* when the attachment fasteners 214*c*, 214*d* fully engaged in the first and second attachment holes 450*a*, 450*b*.

As shown in FIG. 3, the front face 446*a* of the inserted pad plate 310 may form a single continuous surface 385 with the front face 472*a* of the pad 112, though the pad plate 310 may be configured to extend longitudinally outward beyond the front face 472*a* of the pad 112 and/or to at least partially cover a portion of the front face 472*a* of the pad 112.

As shown in FIGS. 3-4B, the pad depression 483 may be shaped to not only selectively receive the pad plate 310, but also to selectively receive a portion of the adjustment fastener 322 (e.g., an enlarged head of the adjustment fastener 322). In particular, the pad depression 483 may include a fastener receiving portion 487 located along the transverse length of the pad 112 such that the fastener receiving portion 487 is at least partially aligned with the plate slot 454 when the pad 112 is fixed to the pad plate 310. The longitudinal length of the pad depression 483 may be at a maximum extent at the fastener receiving portion 487 such that the portion of the adjustment fastener 322 received in the fastener receiving portion 487 may be positioned between the pad 112 and the rear face 446*b* of the inserted pad plate 310 without disrupting the continuity between the front faces 446*a*, 472*a* of the inserted pad plate 310 and the pad 112. Although the fastener receiving portion 487 is shown being elongate and having a longest dimension oriented along the lateral dimension, the fastener receiving portion 487 may have any desired shape and/or may directly correspond to (while being at least the same size as) the portion of the adjustment fastener 322 configured to be received in the fastener receiving portion 487.

The pad 112 may also include an adjustment hole 478 extending longitudinally through the entirety of the pad 112. The adjustment hole 478 may be located transversely between the first and second attachment holes 476*a*, 476*b* of the pad 112. The adjustment hole 478 may also be located along the transverse length of the pad 112 such that the adjustment hole 478 is at least partially aligned with the plate slot 454 when the pad 112 is fixed to the pad plate 310. Therefore, when the adjustment hole 478, the pad depression 483 and the fastener receiving portion 487 are provided, the adjustment hole 478 may extend longitudinally through each of the pad depression 483 and the fastener receiving portion 487.

Although the pad plate 310 is depicted as being selectively inserted into the pad depression 483, the pad plate 310 may be external to the pad depression 483, such as by being located on or adjacent to the front face 472*a* of the pad 112. Furthermore, although the pad plate 310 has been shown as being selectively maintained in the within the pad depression 483 via the attachment fasteners 414*c*, 414*d*, the pad plate 310 may instead, or additionally, be selectively or substantially permanently maintained within the pad depression 483 via a press-fit or frictional engagement or any other suitable engagement mechanism.

Returning to FIGS. 1-4B, the firearm butt assembly 100 is applied to the buttstock 104 of the firearm 106 by placing the adjustment nut 218 into the base depression 437, so that the adjustment nut 218 can be interposed between the base plate 208 and the spring plate 409. The adjustment nut 218 is shown as being substantially rectangular (e.g., square) in cross-section, and thus includes two opposed parallel and substantially flat lateral sides 492*a*, 492*b* and two opposed parallel and substantially flat transverse sides 494*a*, 494*b*. The adjustment nut 218, however, may instead have a round (e.g., circular) or any other desired cross-sectional shape. The adjustment nut includes a bore 496 extending entirely longitudinally through the adjustment nut 218. The bore 496 may be threaded so as to selectively receive the adjustment fastener 322 in threaded engagement. The adjustment nut 218 and/or the adjustment fastener 322 may be at least partially formed from rubber, plastic (high density or otherwise), metal, any other at least partially rigid material, or any combination thereof.

The adjustment nut 218 is arranged in the base depression 437 so that its lateral sides 492*a*, 492*b* are adjacent to and/or contact the lateral sides 439*a*, 439*b* of the base plate 208 and a bore 496 of the adjustment nut 218 is aligned with the base slot 432. The adjustment nut 218 is laterally longer than the base slot 432, and thus the adjustment nut 218 is prevented from undesirably passing longitudinally through the base slot 432. The base depression 437 is transversely longer than the adjustment nut 218. The adjustment nut 218 may thus be selectively moved transversely along the base depression 437. This provides the user with some transverse "play" when setting up the assembly 100. However, the adjustment nut 218 is limited in rotating by interaction of the lateral sides 492*a*, 492*b* of the adjustment nut 218 against the lateral sides 439*a*, 439*b* of the base plate 208. As such, the adjustment nut 218 has adjustability in the transverse direction, but is prevented from rotating and thus from undesirably threadably disengaging from the engaged adjustment fastener 222. When the adjustment nut 218 is fully seated in the base depression, a front face 484 of the adjustment nut 218 may be substantially flush with the front face 424*a* of the base plate 208.

The spring plate 409 is joined to the base plate 208 such that the front face 424*a* of the base plate 208 contacts the rear face 445*b* of the spring plate 409 and the adjustment nut 218 is positioned between the base plate 208 and the spring plate 409. The spring plate 409 is also positioned on the base plate 208 such that the first and second securing holes 453*a*, 453*b* of the spring plate 409 are aligned with the first and second securing bores 455*a*, 455*b* of the base plate 208. The attachment fasteners 414*e*, 414*f* are passed through the first and second securing holes 453*a*, 453*b*, and then threadably engaged with the first and second securing bores 455*a*, 455*b* of the base plate 208. This engagement secures the spring plate 409 (e.g., at the first spring end 447*a* of the spring plate 409) to the base plate 208. Furthermore, the pin projections 457 extend at least partially into the projection apertures 443 of the base plate 208 when the spring plate 409 is attached to the base plate 208.

The combined base plate 208, spring plate 409, and adjustment nut 218 may then be inserted into the buttstock depression 798. As discussed above, when inserted, the spring plate 409 is interposed longitudinally between the base plate 208 and the depression end surface 761 and the first and second free foot ends 429, 451 each directly contact the depression end surface 761. The combined base plate 208, spring plate 409, and adjustment nut 218 are also positioned in the buttstock depression 798 such that the first attachment hole 428*a* of the base plate 208 and the attachment hole 459 of the spring plate 409 are aligned with the first bore 430*a* of the buttstock 104, and the second attachment hole 428*b* of the base plate 208 is aligned with the second bore 403*b* of the buttstock 104. The attachment fastener 414*a* is passed through the first attachment hole 428*a* of the base plate 208 and the attachment hole 459 of the spring plate 409, and then threadably engaged with the first bore 430*a* of the buttstock 104. Similarly, the attachment fastener 414*b* is passed through the second attachment hole 428*b* of the base plate 208 and into a corresponding second bore 403*b* in the depression end surface 761. These engagements secure the combined base plate 208, spring plate 409, and adjustment nut 218 of the assembly 100 onto the firearm 106.

The guide pin 216 may be threadably engaged to a selected one of the pin projections 457 prior to or after the combined base plate 208, spring plate 409, and adjustment nut 218 are secured to the buttstock 104. It is also contemplated that the guide pin 216 may be threadably engaged to a selected one of the pin projections 457 prior to or after the spring plate 409 is joined to the base plate 208. In any case, at least a portion of the guide head 867 may extend longitudinally beyond a corresponding one of the projection apertures 443 on the rear face 424*b* side of the base plate 208 when the guide pin is threadably engaged to the selected pin projection 457 and the spring plate 409 is connected to the base plate 208.

A shank 489 (e.g., a threaded shank 489) of the adjustment fastener 322 may be inserted through the plate slot 454 such that an enlarged head 491 of the adjustment fastener 322 is located on the rear face 446*b* side of the pad plate 310. The plate slot 454 is laterally longer than a length of an outer dimension of the shank 489. The shank 489 (and, accordingly, the adjustment fastener 322 as a whole) may thus be selectively moved laterally along the plate slot 454. This provides the user with some lateral "play" when setting up the assembly 100.

The combined pad plate 310 and adjustment fastener 322 may then be inserted into the pad depression 483 with the adjustment fastener being aligned with and received within the fastener receiving portion 487 of the pad depression 483 such that at least a portion of the head 491 of the adjustment fastener 322 is located longitudinally between pad plate 310 and the pad 112. Although the adjustment fastener 322 is characterize herein as being joined to the pad plate 310 prior to being joined to the pad 112, the adjustment fastener may instead be inserted into the fastener receiving portion 487 of the pad 112 first and then joined to the pad plate 310, as desired.

The pad plate 310 and the adjustment fastener 322 may be aligned relative to the pad 112 such that the plate slot 454 and the head 491 of the adjustment fastener 322 are aligned with the adjustment hole 478 of the pad 112. Such an alignment allows the user to access the adjustment fastener 322 from a side of the pad 112 located opposite the pad plate 310 even after the pad plate 310 and the adjustment fastener 322 have been joined to the pad 112. The pad plate 310 is also positioned in the pad 112 such that the first and second attachment holes 450*a*, 450*b* of the pad plate 310 are aligned with the first and second attachment holes 476*a*, 476*b* of the pad 112. The fasteners 414*c*, 414*d* are passed through the first and second attachment holes 476*a*, 576*b* of the pad 111, and then threadably engaged with the first and second attachment holes 450*a*, 450*b* of the pad plate 310. This engagement removably secures the pad plate 112 to the pad 112, and selectively retains the adjustment fastener 322 such that the head 491 is in the fastener receiving portion 487 on the rear face 446*b* side of the pad plate 310 and the shank 489 extends through the plate slot 454.

The combined pad 112, pad plate 310, and adjustment fastener 322 is then joined to the base plate 208, and thus indirectly to the buttstock 104 via the base plate 208. In particular, the combined pad 112, pad plate 310, and adjustment fastener 322 is positioned such that the front face 446*a* of the pad plate 310 contacts or is adjacent to the rear face 424*b* of the base plate 208. The pad 112 is also positioned such that the front face 472*a* of the pad contacts or is adjacent to the longitudinal end face 102 of the buttstock 104. The combined pad 112, pad plate 310, and adjustment fastener 322 are aligned relative to the base plate 108 such that the plate slot 454 and the adjustment hole 478 are at least partially aligned with the base slot 432 and the bore 496 of the adjustment nut 218. The guide pin 216, being removably attached to the spring plate 409, is also aligned with and inserted at least partially into the guide track 464 as the pad plate 310 is aligned with and joined to the base plate 208. When inserted into the guide track 464, the first head projecting portion 873*a* of the guide pin 216 is received in the track groove 479 and the track projecting portion 981 of the track wall 477 is received in the head groove 871 of the guide pin 216.

The adjustment fastener 322 is then at least partially threaded into the bore 496 of the adjustment nut 218. Engagement of the adjustment fastener 322 in the adjustment nut 218 couples the pad plate 310 and the pad 112 to the base plate 208, and thus indirectly couples the pad plate 310 and the pad 112 to the buttstock 104.

The adjustment fastener 322 may be manipulated between a clamped condition and an unclamped condition via rotation of the adjustment fastener 322 when threadably engaged to the adjustment nut 218. In other words, the attachment fastener 322 is selectively movable between the unclamped and clamped conditions via engagement with the adjustment nut 218. In the clamped condition, the adjustment fastener 322 is at least substantially, such as fully, threaded into the adjustment nut 218. The substantially threaded adjustment fastener 322 provides a first longitudinal compressive force on the pad plate 310 that urges the pad plate 310 toward and/or into the base plate 208.

Figure 10:
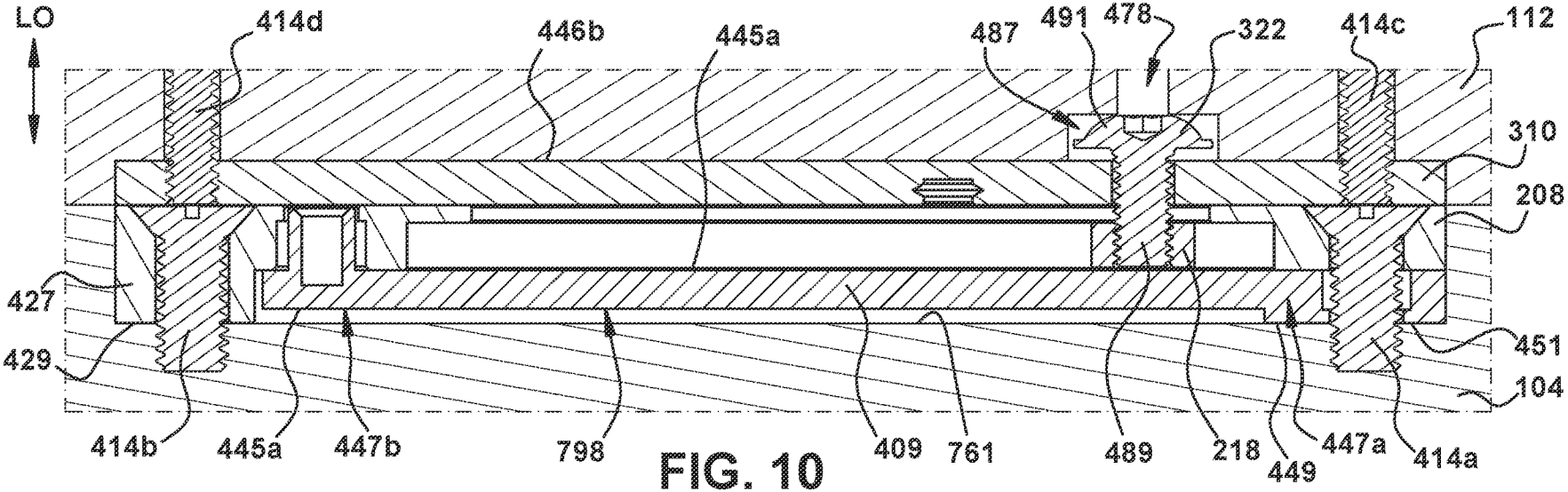
FIG. 10 is a partial cross-sectional view of the assembly of FIG. 1, including the assembly in the first condition.
Figure 11:
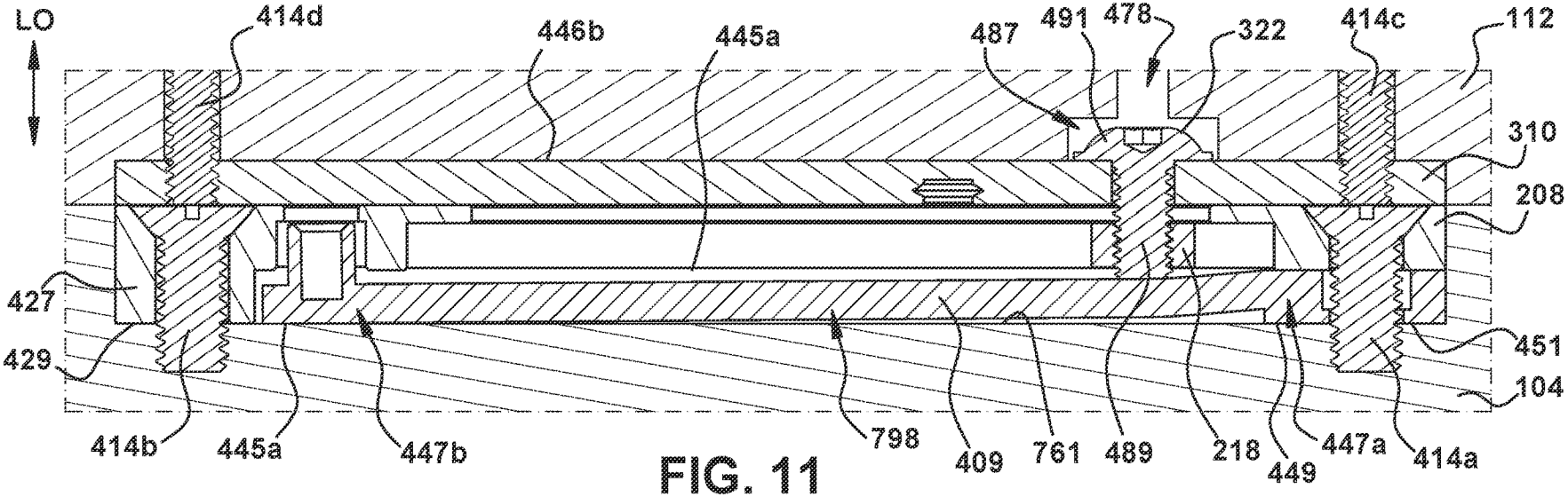
FIG. 11 is a partial cross-sectional view of the assembly of FIG. 1, including the assembly in a second condition.

Furthermore, as shown in FIGS. 9-11, as the adjustment fastener 322 is moved toward the clamped condition (FIG. 11), the shank 489 is urged into, or further into, contact with the rear face 445*b* of the spring plate 409. After such contact occurs, advancing the adjustment fastener further toward the clamped condition responsively causes or urges the second spring end 447*b* of the spring plate 409 to pivot longitudinally from the unflexed condition (FIG. 10) toward the depression end surface 761 of the buttstock 104 against the innate elastic bias of the spring plate 409. The pivoting spring plate 409 responsively pulls or urges the attached guide pin 216 to move longitudinally toward the depression end surface 761. As the guide pin 216 is pulled, the first head projecting portion 873*a* applies a second longitudinal compressive force to the pad plate 310 (e.g., to the track projecting portion 981) that further urges the pad plate 310 toward and/or into the base plate 208. The second spring end 447*b* of the spring plate 409 may be pivoted via the adjustment fastener 322 until the second spring end 447*b* of the spring plate 409 contacts the depression end surface 761 (in which case the adjustment fastener 322 is fully or at least substantially threaded into the adjustment nut 218) and/or until the head 491 of the adjustment fastener 322 bottoms out on the rear face 446*b* of the pad plate 310 (in which case the adjustment fastener 322 is fully threaded into the adjustment nut 218). Therefore, in the clamped condition the adjustment fastener 322 is fully or at least substantially threaded into the adjustment nut 218, the second spring end 447*b* of the spring plate 409 is maintained in a fully or at least substantially pivoted condition via the adjustment fastener 322, and the pad plate 310 is subjected to the first and second longitudinal compressive forces. The first and second longitudinal compressive forces cooperatively urge the pad plate 310 toward the base plate 208 such that the pad plate 110 is substantially or at least partially prevented from undesirably moving relative to the base plate 208. Furthermore, the first and second longitudinal compressive forces (especially the second longitudinal compressive force) helps eliminate or at least partially reduce any longitudinal gaps between the front face 472*a* of the pad 112 and at least one of the buttstock cover 265 (when provided) and the longitudinal end surface 102 of the buttstock 104.

In the unclamped condition (FIG. 10), the adjustment fastener 322 is at least partially loosened such that the adjustment fastener 322 is not fully or substantially threaded into the adjustment nut 218. Furthermore, the second spring end 447*b* of the spring plate 409 in the unclamped condition may be in the unflexed condition or at least a partially flexed condition where the second spring end 447*b* of the spring plate 409 is not fully or substantially flexed and is at least partially spaced from the depression end surface 761. The loosened adjustment fastener 322 alleviates a least a portion of the first and second longitudinal compressive forces so that the pad plate 310 may be selectively moved relative to the base plate 208.

When the pad plate 310 is coupled to the base plate 208 and the adjustment fastener 222 is in the unclamped condition, the pad plate 310 and attached pad 112 can be selectively moved in the transverse and lateral directions, as well as selective pivoted about the adjustment fastener 322 and/or the guide pin 216. For example, as shown in FIGS. 12A-12B, the pad plate 310 may be moved or slid in the transverse direction from a starting position (FIG. 12A) relative to the base plate 208. The adjustment fastener 322 is responsively slid or moved in the transverse direction by the transversely moving pad plate 310. The adjustment fastener 322, being at least partially threadably engaged to the adjustment nut 218, carries the adjustment nut 218 along as the adjustment fastener 322 is slid transversely, the motion of which causes the adjustment nut 218 to responsively slide transversely along the base slot 432. Furthermore, as shown in FIGS. 12A-12B, the guide pin 216 slides transversely along a selected one of the transverse guide track portions 468*a* as the pad plate 310 is transversely slid. Therefore, the guide pin 216 slides along the guide track 464 responsive to certain movements of the pad plate 310 relative to the base plate 208 and the guide pin 216. Contact between the guide pin 216 and transverse portions of the track wall 477 provides a limit for the transverse movement of the pad plate 310. Contact between the adjustment nut 218 and the transverse ends 441*a*, 441*b* of the base plate 208 may also provide a limit for the transverse movement of the pad plate 310.

Figure 12C:
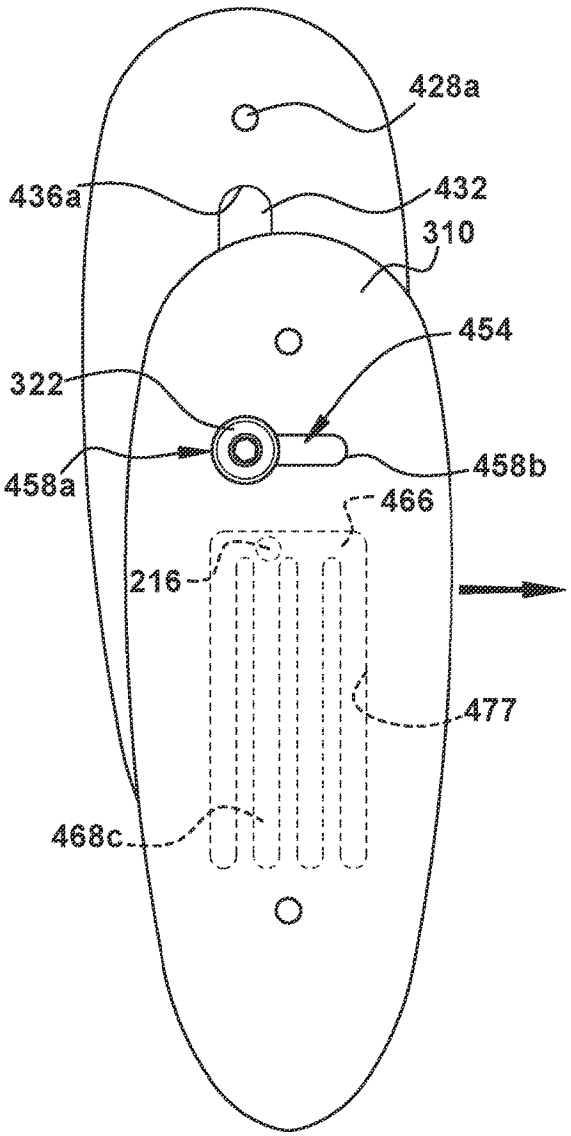
Figure 12B:
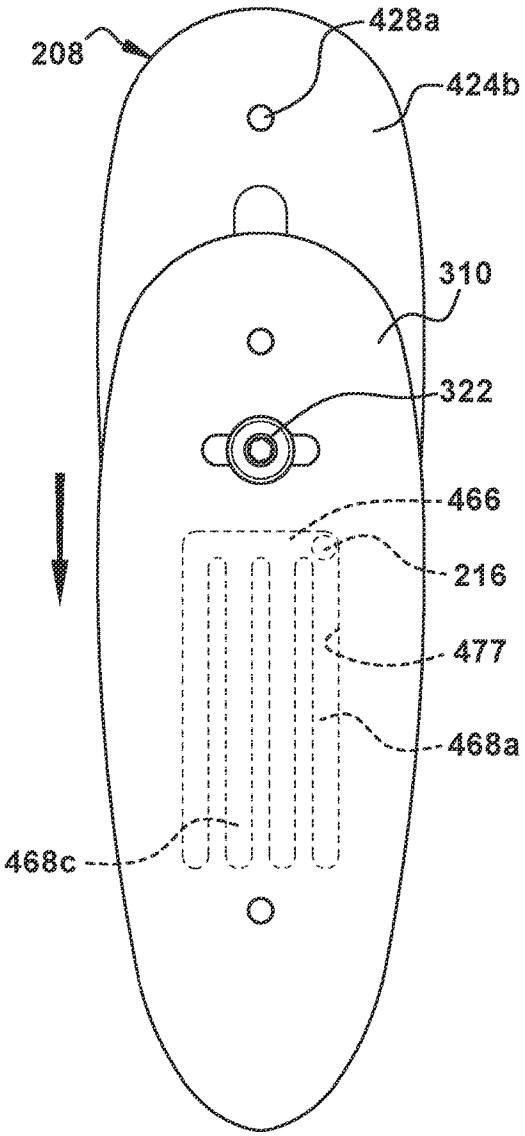
Figure 12A:
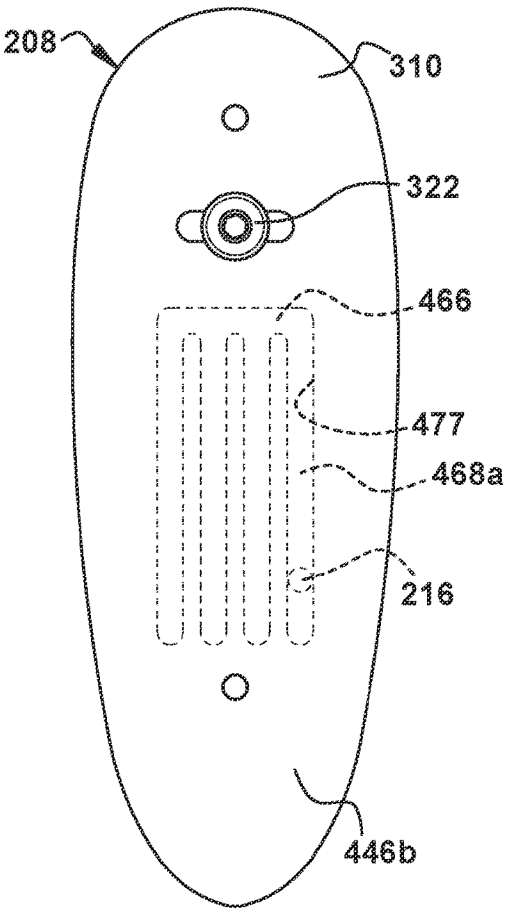

As shown in FIGS. 12B-12C, when the guide pin 216 is located in the lateral guide track portion 466, the pad plate 310 may be moved or slid in the lateral direction from a starting position (FIG. 12B) relative to the base plate 208. The adjustment fastener 322 is responsively slid or moved in the lateral direction along the pad slot 454 by the laterally moving pad plate 310. Furthermore, as shown in FIGS. 12B-12C, the guide pin 216 slides laterally along the lateral guide track portion 466 as the pad plate 310 is laterally slid. Contact between the guide pin 216 and lateral portions of the track wall 477 provides a limit for the lateral movement of the pad plate 310. Contact between the adjustment fastener 322 and the lateral ends 458*a*, 458*b* of the pad slot 454 may also provide a limit for the lateral movement of the pad plate 310.

Referring to FIG. 12C, the lateral movement of the pad plate 310 may align the guide pin 216 with an other one of the transverse guide track portions 468*a-d*. In such case, as shown in FIGS. 12C-12D, the pad plate 310 may again be selectively slid in the transverse direction from a starting position (FIG. 12C) relative to the base plate 208. The guide pin 216 slides transversely along the respective transverse guide track portion 468*c* as the pad plate 310 is transversely slid. Therefore, the guide pin 216 may be selectively moved from one transverse guide portion 468*a-d* to another transverse guide portion 468*a-d* via the lateral guide track portion 466.

Figure 12E:
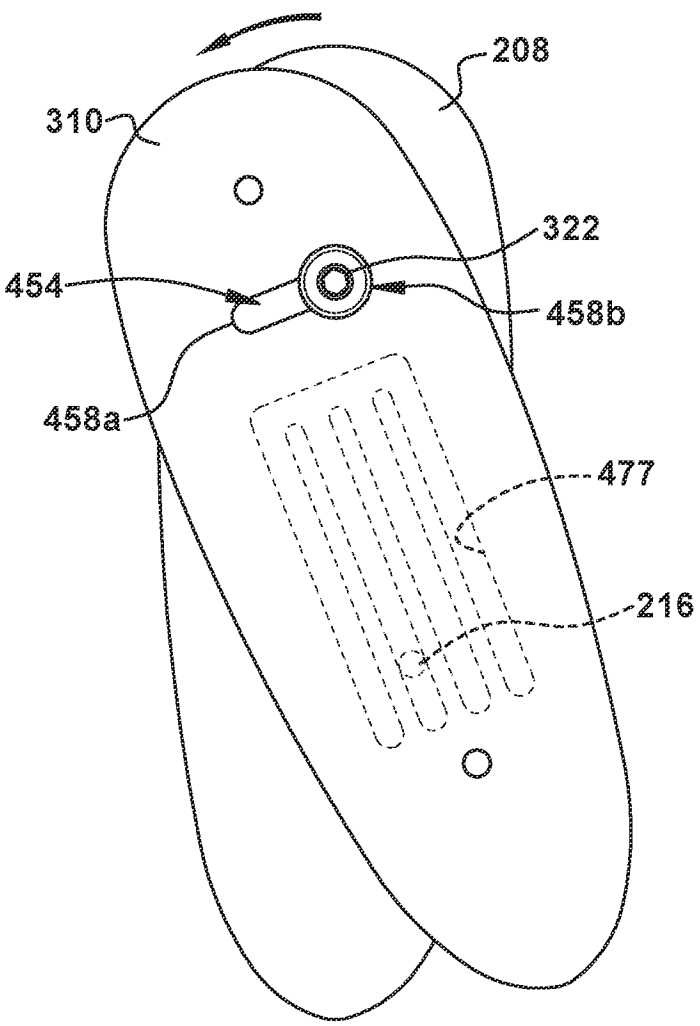
Figure 12D:
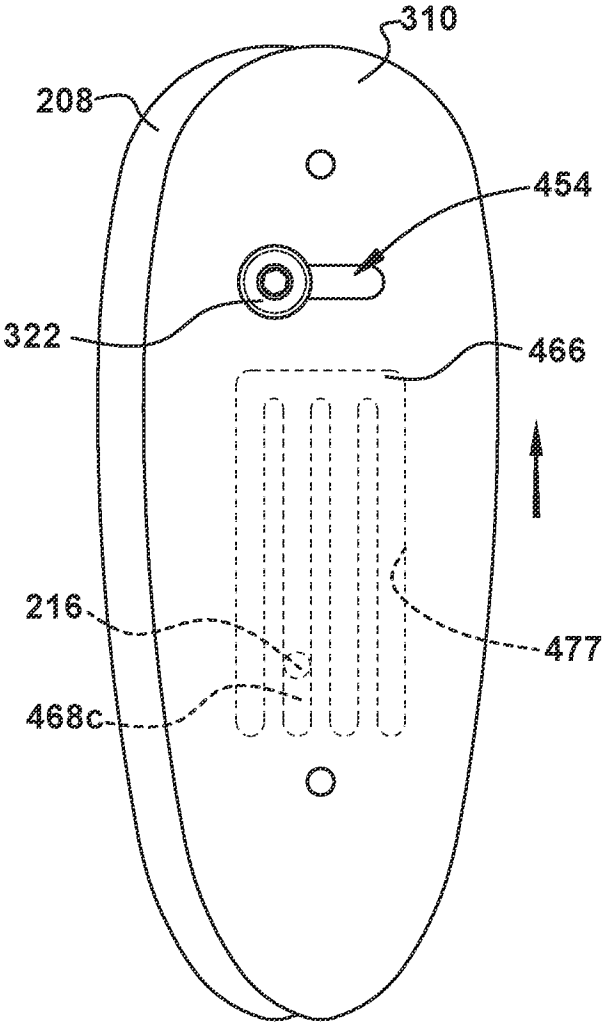

As shown in FIGS. 12D-12E, the pad plate 310 may also be rotated with respect to the base plate 208 (and thus the buttstock 104). For example, the pad plate 210 may be rotated in a clockwise or counterclockwise direction about the guide pin 216 from a starting position (FIG. 12D) relative to the base plate 208. Contact between the adjustment fastener 322 and the lateral ends 458*a*, 458*b* of the pad slot 454 provides a limit for the rotation of the pad plate 310. In certain situations, contact between the guide pin 216 and the track wall 477 may also limit the rotation of the pad plate 310.

Therefore, as shown in FIGS. 12A-12E, the pad plate 310 may be adjusted relative to the base plate 208 and the buttstock 104 via transverse, lateral, and/or rotational movements of the pad plate 310. By transversely sliding the pad plate 310, lateral sliding the pad plate 310, and/or rotating the pad plate 310, the orientation of the pad plate 310 may be customized to the user's anatomy, such as to the anatomy of the user's chest/shoulder area. The pad plate 310 may be transversely slid, laterally slid, and/or rotated in any sequence. However, as discussed above, the transverse, lateral, and rotational adjustment of the pad plate 310 may be limited by the adjustment nut 218, the adjustment fastener 322, and the guide pin 216. Although the pad 112 has been omitted from FIGS. 12A-12E for clarity, the selective transverse, lateral, and/or rotational movements of the pad plate 310 are directly applicable to the pad 112 due to their mutual fixation.

Once a desired or predetermined orientation of the pad 112 and the pad plate 310 has been achieved, the adjustment fastener 322 may be manipulated (e.g., rotated) into the clamped condition to substantially prevent the pad 112 and the pad plate 310 from undesirably egressing from the desired orientation. As another means of securement, contact between the guide pin 216 and the track wall 477 may also at least partially restrict the movements of the pad plate 310 relative to the base plate 208 when in the clamped condition such that the pad plate 310 may be at least partially prevented from undesirably egressing from the desired orientation. Therefore, the guide pin 216, the track wall 477, and the interactions therebetween, provide another mechanism for resisting undesirable pad plate movement, and one that is not known to be available in other commercially available firearm butt assemblies.

The guide pin 216, the track wall 477, and the interactions therebetween also at least partially prevent the pad plate 310 from being undesirably detached from the base plate 208 when the guide pin 216 is inserted into the guide track 464. For example, longitudinal forces that urge the attached base plate 208 and pad plate 310 to longitudinally separate from one another at least partially urge portions of track projecting portion 981 into contact with, or into further contact with, portions of the first head projecting portion 873 of the guide pin 216. This contact at least partially prevents the longitudinal forces from undesirably separating the attached base plate 208 and pad plate 310 from one another. Furthermore, in addition to having the above described features for at least partially preventing the attached base plate 208 and pad plate 310 from undesirably separating from one another, the guide pin 216 and/or the guide track 464 may have any other feature, projection, slot, or other structure(s) providing similar functionality.

Figure 13:
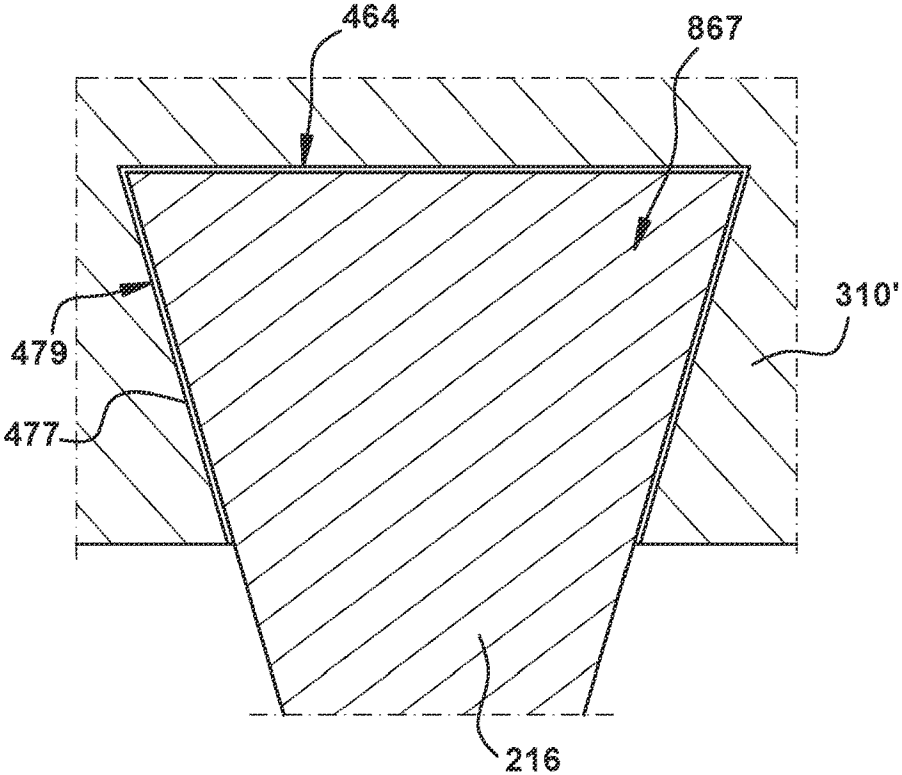
FIG. 13 is a partial cross-sectional view of another example configuration of the adjustable firearm butt assembly of FIG. 1.

Although at least the guide head 867 of the guide pin 216 has been shown as being substantially circular in cross-section with a head groove 871, the guide pin 216 may have any other desired shaped/configuration. For example, as shown in FIG. 13, at least the guide head 867 may be dovetail-shaped in cross-section. The track groove 479 of the track wall 477 may be configured in a corresponding dovetail-shape to receive the dovetail-shaped guide head 867 in a mating arrangement when the guide pin 216 is inserted into the guide track 464.

The guide pin 216 and guide track 264 configuration of FIG. 13 provides similar functionality to that of the guide pin 216 and guide track 464 configuration of FIGS. 4A-4B. As one example, the longitudinal forces that urge the attached base plate 108 and pad plate 110 to longitudinally separate from one another at least partially urge portions of the dovetail-shaped guide head 867 substantially longitudinally into contact with, or into further contact with, portions of the pad plate 310 that define the dovetail track groove 479 (e.g., portions of the track wall 477). This contact at least partially prevents undesirable separation of the attached base plate 208 and pad plate 310 from one another.

Figure 14:
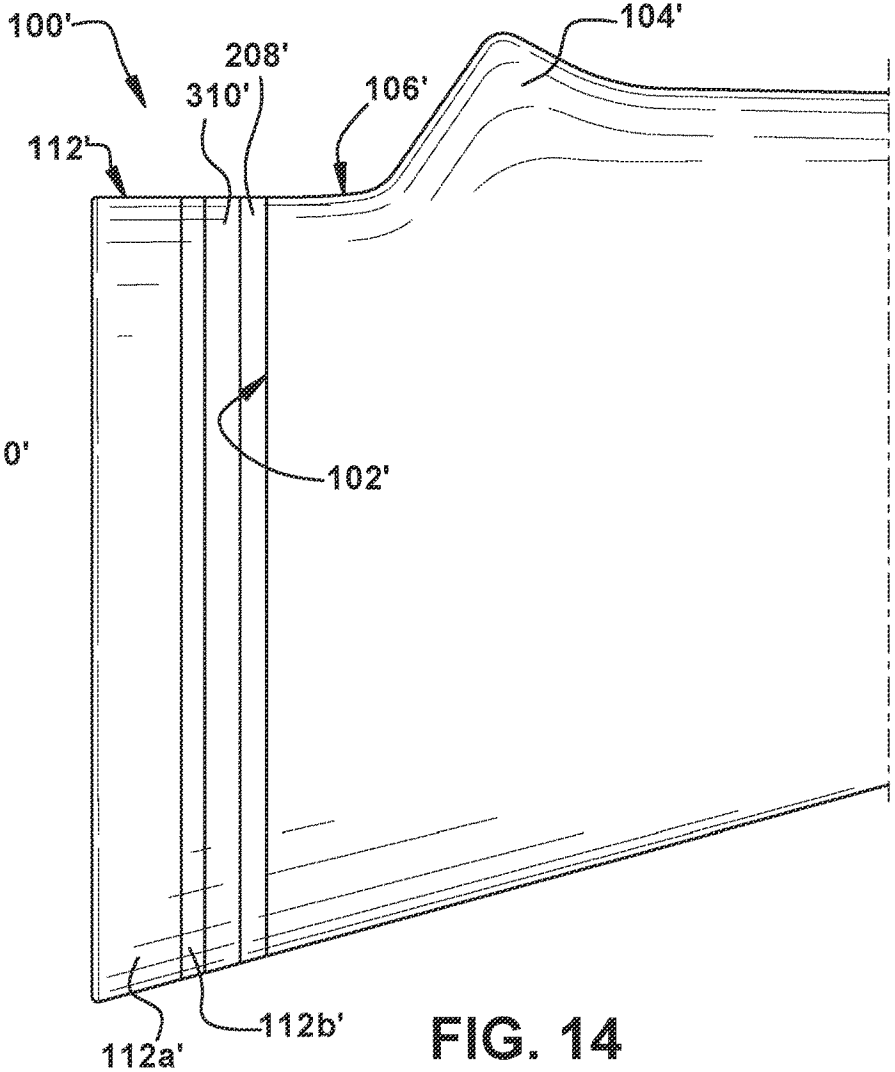
FIG. 14 is a side view of the adjustable firearm butt assembly according to another aspect of the present disclosure, depicting the adjustable firearm butt assembly in an example use environment.

FIGS. 14-16 illustrate another configuration of an adjustable firearm butt assembly 100'. The assembly 100' of FIGS. 14-16 is similar to the assembly 100 of FIGS. 1-12E and therefore, structures of FIGS. 14-16 that are the same as or similar to those described with reference to FIGS. 1-12E have the same reference numbers with the addition of a "prime" mark. Description of common elements and operation similar to those in the previously described first embodiment may not be repeated with respect to the second embodiment, but should instead be considered to be incorporated below by reference as appropriate. Furthermore, elements shown or described with respect to one embodiment may be shared by any of the other embodiments whether expressly stated, shown, or not.

FIG. 14 depicts the adjustable firearm butt assembly 100' selectively attached to the longitudinal end surface 102' of a buttstock 104' of a firearm 106'. As shown in FIGS. 14-15B, the assembly 100' includes the base plate 208', the pad plate 310', and the pad 112', and not a spring plate 409.

The assembly 100' also includes the plurality of attachment fasteners 414*a*'-d' for coupling portions of the assembly 100' to one another and for mounting the assembly 100' to the buttstock 104'. Furthermore, the assembly 100' includes the guide pin 216', the adjustment nut 218' (hereinafter, the first adjustment nut 218'), a second adjustment nut 1520, and the adjustment fastener 322'. The guide pin 216', the first adjustment nut 218', the second adjustment nut 1520, and the adjustment fastener 222' allow the user to selectively adjust and customize the location and orientation of the pad plate 310' and the pad 112' relative to the base plate 208' and the buttstock 104', thereby increasing the surface area of the pad 112' in contact with the user and improving the flushness of the pad 112' against the user's body. This allows the user to select a customized and comfortable interface with the firearm 106'.

The shape of the base plate 208' may correspond to the shape of the buttstock 104', so that when the base plate 208' is attached to the buttstock 104', the base plate 208' may comprise a contiguous extension of the buttstock 104'.

The base plate 208' may be selectively fixed to the longitudinal end surface 102' of the buttstock 104' via the attachment fasteners 414*a*', 414*b*' that extend through the first and second attachment holes 428*a*', 428*b*' and into corresponding first and second bores 430*a*', 430*b*' in the longitudinal end surface 102' of the buttstock 104'.

As shown in FIG. 15B, a substantially rectangular base guide wall 1538 may extend longitudinally from the front face 424*a*' of the base plate 208'. The base guide wall 1538 surrounds, though is spaced from, the base slot 432'. Like the base slot 432', the base guide wall 1538 is elongate and has a longest dimension oriented in the transverse direction. The base guide wall 1538 has parallel, substantially straight lateral sides 1540*a*, 1540*b*, flanked by a substantially straight transverse ends 1542*a*, 1542*b*. Although the base guide wall 238 has been shown as being substantially rectangular, the base guide wall 1538 may have any other desired shape. For example, the shape of the base guide wall 1538 may correspond to the shape of the base slot 432'.

Instead of having the base guide wall 1538, the base plate 208' may include a base depression 437 like that of the base plate 208 of FIGS. 1-12. Such a base depression of the base plate 208' may be substantially rectangular, may correspond to the shape of the base slot 432, or may have any other desired shape. Similarly, the base plate 208 of FIGS. 1-12 may be configured as having the base guide wall 1538 instead of the base depression 437. The base guide wall 1538 thus functions like that of the base depression 437.

To compensate for the lack of spring plate 409 in the assembly 100' of FIGS. 14-16 as compared to the assembly 100 of FIGS. 1-13, the base plate 208' shown in FIGS. 14-16 includes one or more pin apertures 444*a*'-c' formed into the rear face 424*b*' of the base plate 208'. Each pin aperture 444*a*'-c' is a blind recess extending slightly into the rear face 424' only. However, at least one of the pin apertures 444*a*'-c' may be configured to extend entirely longitudinally through the base plate 208'.

Figure 16C:
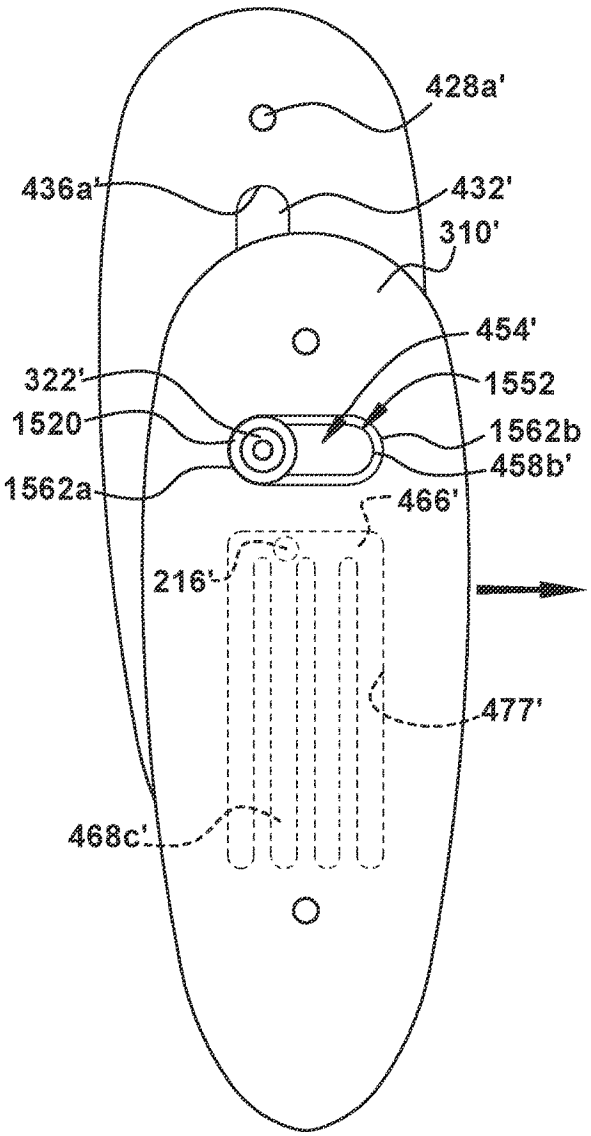
FIGS. 16A-16E illustrate an example sequence of operation of the assembly of FIG. 14.
Figure 16B:
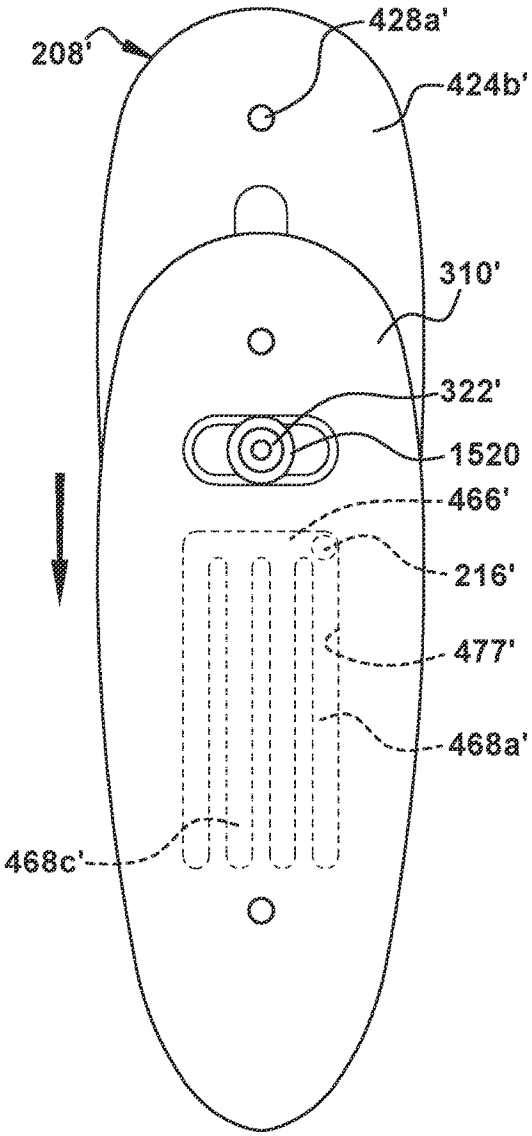
Figure 16A:
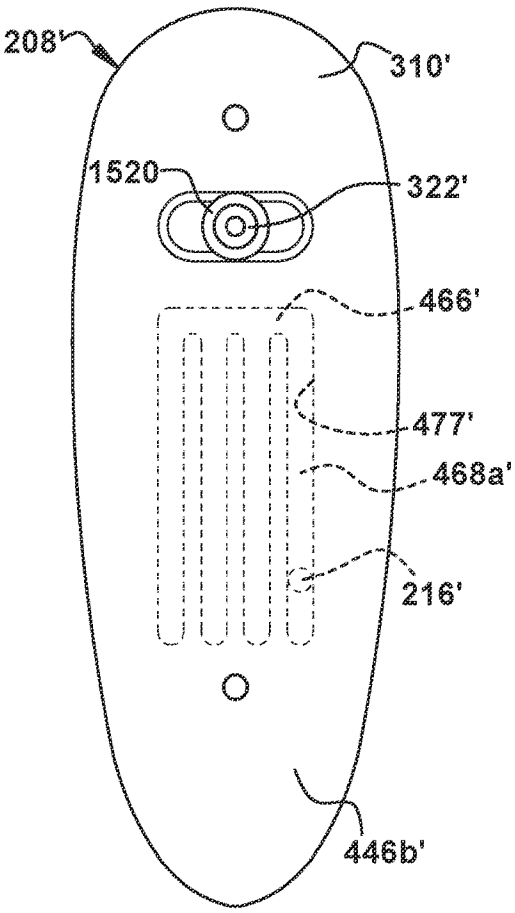

The guide pin 216' shown in FIG. 16A is substantially cylindrical, though the guide pin 216' may have any other desired shape. For example, the shape of the guide pin 216 may be selected to correspond to the shape of the pin apertures 444*a*'-c'. Alternatively or additionally, the guide pin 216' may have a similar construction to those shown in any of FIGS. 1-13. It should also be appreciated that the guide pin 216 of FIGS. 1-12 may be substantially similar that shown in FIG. 16A.

The guide pin 216' and the pin apertures 444*a-c* may be configured so that a press-fit and/or frictional engagement is created between the guide pin 216' and the pin apertures 444*a*'-c' when the guide pin 216' extends into a selected one of the pin apertures 444*a*'-c'. The press-fit and/or frictional engagement between the guide pin 216' and the pin apertures 444*a*'-c' may help prevent the guide pin 216' from being undesirably removed from the pin aperture 444*a*'-c' in which the guide pin 216' is inserted. Alternatively, the guide pin 216' may be configured to be threadably engaged to a selected pin aperture 444*a*'-c' in as similar manner as described above. The guide pin 216' and/or the pin apertures 444*a*'-c' are configured such that when the guide pin 216' is inserted into a selected one of the pin apertures 444*a*'-c', a portion of the guide pin 216' extends longitudinally outward from the selected pin aperture 544*a*'-c'.

Figure 15A:
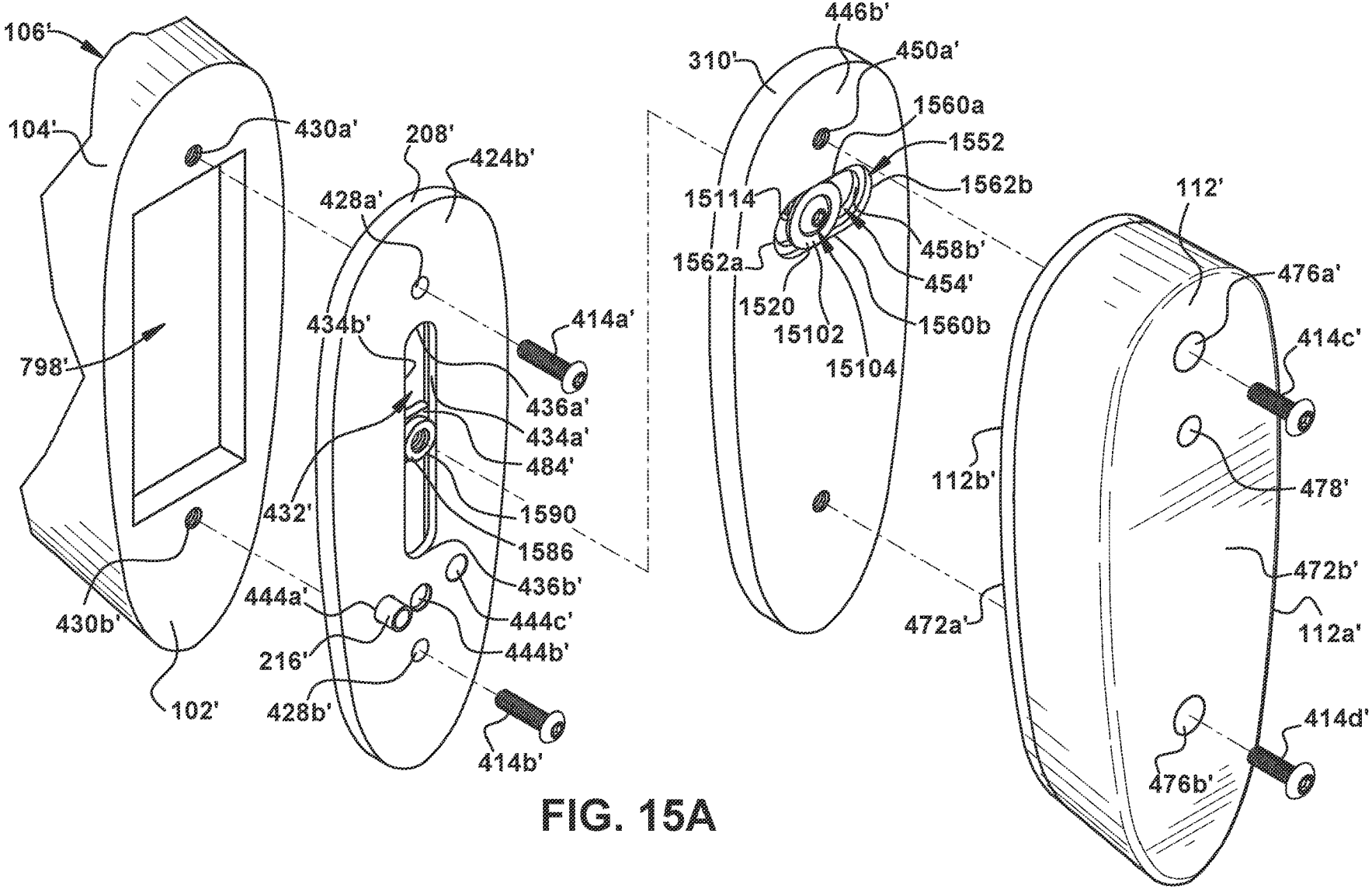
FIG. 15 is a partially exploded perspective rear view of the assembly of FIG. 14.
FIG. 15B is a partially exploded perspective front view of the assembly of FIG. 14.
Figure 15B:
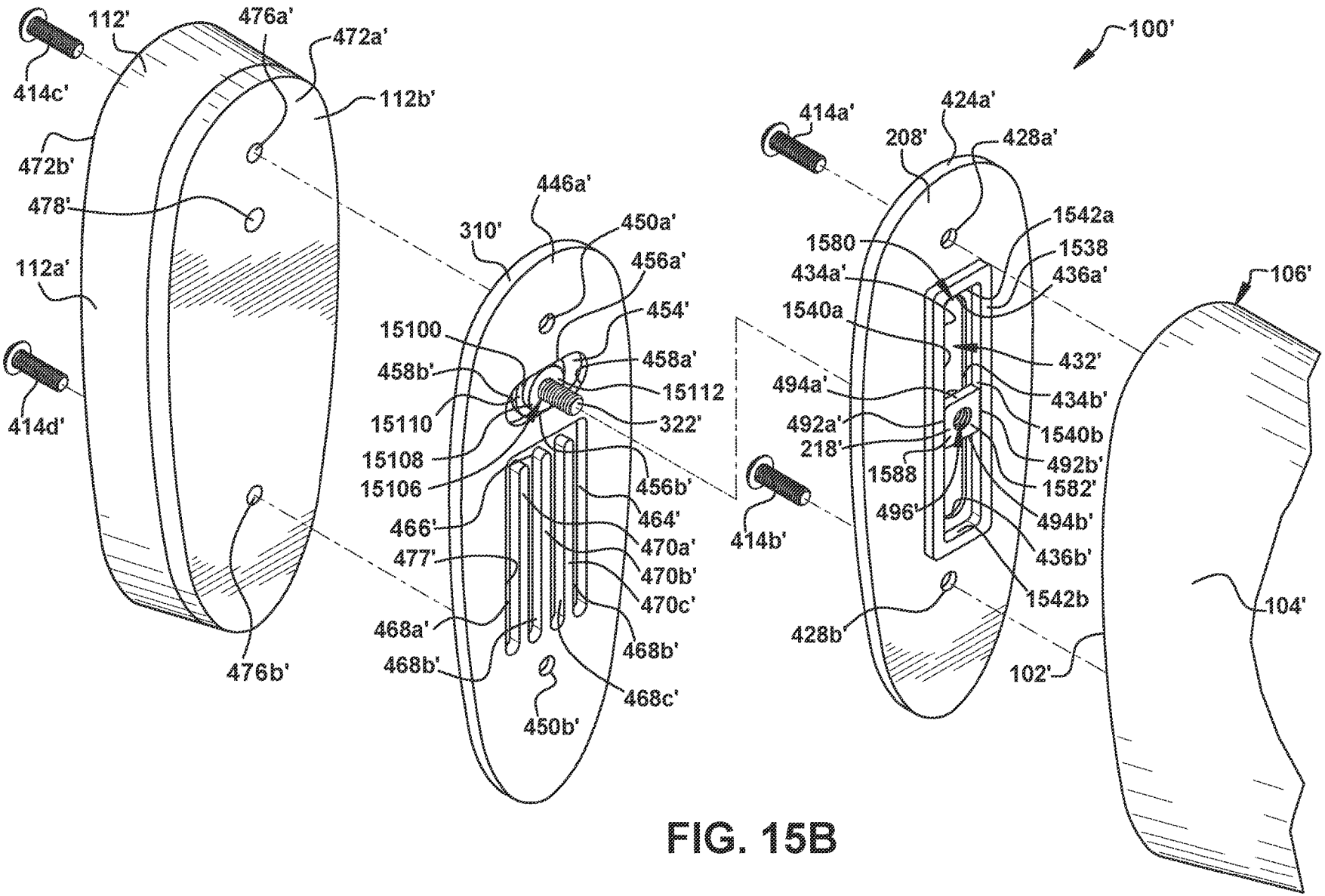

Referring now to FIGS. 15A-15B, the pad plate 310' is mountable to the base plate 208'. The shape of the pad plate 310' may correspond to the shape of the base plate 208' so that the pad plate 310' may, in certain orientations, comprise a contiguous extension of the base plate 208' when mounted thereto.

As shown in FIG. 15A, a substantially oval plate depression 1552 is formed into the rear face 446*b*' of the pad plate 310' around the plate slot 454, though the pad plate 310' may be constructed with the plate depression 1552 omitted. The plate depression 1552 is a blind recess extending slightly into the rear face 446*b*' only. The plate depression 1552 encircles or surrounds the plate slot 454' and roughly corresponds to the plate slot 454' in shape, though the plate depression 1552 may have any other desired shape. Like the plate slot 454', the plate depression 1552 is elongate in the lateral direction. The plate depression 1552 has parallel, straight transverse sides 1560*a*, 1560*b*, flanked by a semicircular lateral ends 1562*a*, 1562*b*.

As shown in FIG. 15B, the guide track 464' is recessed into the front face 446*a*' of the pad plate 410' so that the guide track 464' is at least partially defined by the longitudinally extending track wall 465'. Unlike the track walls 477 of FIGS. 1-12 and 13, the track wall 477' of FIG. 15B does not include a track groove 479. However, the track wall 477' may be configured to have the either of the track grooves 479 of FIG. 1-12 or 13 depending on the configuration of the guide pin 216'. Similarly, the track groove 479 may be omitted from the pad plate 310 of FIGS. 1-12 depending on the configuration of the guide pin 216.

Referring now to FIGS. 15A-15B, the pad 112' may be selectively fixed to the rear face 446*b*' of the pad plate 310' via attachment fasteners 414*c*', 414*b*' that extend through the first and second attachment holes 476*a*, 476*b* of the pad 112' and into the corresponding first and second attachment holes 450*a*', 450*b*' of the pad plate 310'. The shape of the pad 112' may correspond to the shape of the pad plate 310' so that the pad 112' may, in certain orientations, comprise a contiguous extension of the pad plate 310' when mounted thereto.

Referring to FIGS. 14-15B, the firearm butt assembly 100' is applied to the buttstock 104' of the firearm 106' by placing the first adjustment nut 218' into an interior adjustment cavity 1580 defined by the base guide wall 1538 and the base plate 208', so that the first adjustment nut 218' can be interposed between the buttstock 104' and the base plate 208'. The first adjustment nut 218' includes a substantially rectangular first flange 1582. The first flange 1582 has a substantially flat first front face 484'. On the opposite side of the first flange 1582, a first collar 1586 projects outwardly from an otherwise substantially flat first rear face 1588. The first collar 1586 extends longitudinally from the first rear face 1588 to a first edge 1590 of the first collar 1586. An outer dimension or diameter of the first collar 1586 corresponds to the lateral width of the base slot 1532. The first flange 1582 has two opposed parallel and substantially flat first lateral sides 492*a*', 492*b*' and two opposed parallel and substantially flat first transverse sides 494'*a*', 494*b*'. A first bore 496' extends entirely longitudinally through the first adjustment nut 218' such that the first bore 496' extends longitudinally between the first front face 484' of the first flange 1582 and the first edge 1590 of the first collar 1586. The first bore 496' may be threaded so as to selectively receive the adjustment fastener 322' in threaded engagement.

The first adjustment nut 218' is arranged in the adjustment cavity 1580 so that the first lateral sides 492*a*', 492*b*' of the first flange 1582 are adjacent to and/or contact the lateral sides 1540*a*, 1540*b* of the base guide wall 1538. The first collar 1586 of the first adjustment nut 218' is fit into the base slot 432'. The adjustment cavity 1580 is transversely longer than the first adjustment nut 218', and the base slot 432' is also transversely longer than an outer dimension of the first collar 1586. The first adjustment nut 218' may thus be selectively moved transversely along the adjustment cavity 1580, with the first collar 1586 responsively moving transversely along the base slot 432'. This provides the user with some transverse "play" when setting up the assembly 100'. However, the first adjustment nut 218' is limited in rotating by interaction of the first lateral sides 492*a*', 492*b*' of the first flange 1582 against the lateral sides 1540*a*, 1542*b* of the base guide wall 1538. As such, the first adjustment nut 218' has adjustability in the transverse direction, but is prevented from rotating and thus from undesirably threadably disengaging from the engaged adjustment fastener 322'. When the first adjustment nut 218' is fully seated in the adjustment cavity 1580, the first front face 484' of the first flange 1582 may be substantially flush with the front face 424*a*' of the base plate 208'.

The base plate 208' is joined to the buttstock 104' such that the front face 424*a*' of the base plate 208' contacts the longitudinal end surface 102' of the buttstock 104' and the first adjustment nut 218' is positioned between the buttstock 104' and the base plate 208'. The base guide wall 1538 (when provided) may also be received in a correspondingly shaped buttstock depression 798' when the base plate 208' is joined to the buttstock 104'. The base plate 208' is also positioned on the buttstock 104' such that the first and second attachment holes 450*a*', 450*b*' of the base plate 208' are aligned with the first and second bores 430*a*', 430*b*' of the buttstock 104'. The fasteners 414*a*', 414*b*' are passed through the first and second attachment holes 450*a*', 450*b*', and then threadably engaged with the first and second bores 430*a*', 430*b*' of the buttstock 104'. This engagement secures the base plate 208' on the firearm 106'.

The pad plate 310' is then joined to the base plate 208' such that the front face 446*a* of the pad plate 310' contacts the rear face 424*b*' of the base plate 208'. The pad plate 310' is also positioned on the base plate 208' such that the plate slot 454' is at least partially aligned with the base slot 432' and the first bore 496' of the first adjustment nut 218'. The guide pin 216' is aligned with and inserted at least partially into the guide track 464' as the pad plate 310' is aligned with and joined to the base plate 208'.

The second adjustment nut 1520 is placed in the plate depression 1552 of the pad plate 310' so that the second adjustment nut 1520 can be interposed between the pad plate 310' and the pad 112'. The second adjustment nut 1520 includes a substantially circular second flange 15100. The second flange 15100 has a substantially flat second rear face 15102. The second rear face 15102 has a nut depression 15104 formed therein around a second bore 15106 of the second adjustment nut 1520. On the opposite side of the second flange 15100, a second collar 15108 projects outwardly from an otherwise substantially flat second front face 15110. The second collar 15108 extends longitudinally from the second front face 15110 to a second edge 15112 of the second collar 15108. An outer dimension or diameter of the second collar 15108 corresponds to a transverse length of the plate slot 454'. The second flange 15100 has an annular flange outer edge 15114. The second bore 15106 extends entirely longitudinally through the second adjustment nut 1520 such that the second bore 15106 extends longitudinally between the second rear face 15102 of the second flange 15100 and the second edge 15112 of the second collar 15108. The second bore 15106 may be smooth (i.e., have no threading) so that the second bore 15106 may selectively receive, but not be threadably engaged to, the adjustment fastener 322'. The second adjustment nut 1520 may be at least partially formed from rubber, high-density plastic (high density or otherwise), metal, any other at least partially rigid material, and/or any combination thereof.

The second adjustment nut 1520 is arranged in the plate depression 1552 such that a portion of the flange outer edge 15114 of the second flange 15100 is adjacent to and/or contacts the transverse sides 1560*a*, 1560*b* of the plate depression 1552. The second collar 15108 of the second adjustment nut 1520 is fit into the plate slot 454'. The plate depression 1552 is laterally longer than the second adjustment nut 1520, and the plate slot 454' is also laterally longer than an outer dimension of the second collar 15108. The second adjustment nut 1520 may thus be selectively moved laterally along the plate depression 1552, with the first collar 15108 responsively moving laterally along the plate slot 454'. This provides the user with some lateral "play" when setting up the assembly 100'. When the second adjustment nut 1520 is fully seated in the plate depression 1552, the second rear face 15102 of the second flange 15100 may be substantially flush with the rear face 446*b* of the pad plate 310'.

The second adjustment nut 1520 is aligned with the first adjustment nut 218' such that the second and first bores 215106, 496' are coaxial to one another. Once aligned, the first and second edges 1590, 15112 of the first and second collars 1586, 15108 may be adjacent to and/or contact one another. The adjustment fastener 322' is then passed through the second bore 15106 of the second adjustment nut 1520 and into the threaded first bore 496' of the first adjustment nut 218'. The adjustment fastener 322' is rotated, at least partially threadably engaging the adjustment fastener 322' with the non-rotatable first adjustment nut 218'. Engagement of the adjustment fastener 322' in the first adjustment nut 218' couples the pad plate 310' to the base plate 208', and thus indirectly attaches the pad plate 310' to the buttstock 204'.

The adjustment fastener 322' may be manipulated between a clamped condition and an unclamped condition via rotation of the adjustment fastener 322' when threadably engaged to the first adjustment nut 218'. In the clamped condition, the adjustment fastener 322' is fully or at least substantially threaded into the first adjustment nut 218'. The fully/substantially threaded adjustment fastener 322' provides a longitudinal compressive force on the pad plate 310' that urges the pad plate 310' toward the base plate 208' to such a degree that the pad plate 310' is substantially prevented from undesirably moving relative to the base plate 208'. However, in the unclamped condition the adjustment fastener 322' is at least partially loosened such that the adjustment fastener 322' is not fully or substantially threaded into the first adjustment nut 218'. The loosened adjustment fastener 322' thus alleviates a least a portion of the longitudinal compressive force to allow the pad plate 310' may be selectively moved relative to the base plate 208'.

Figure 2:
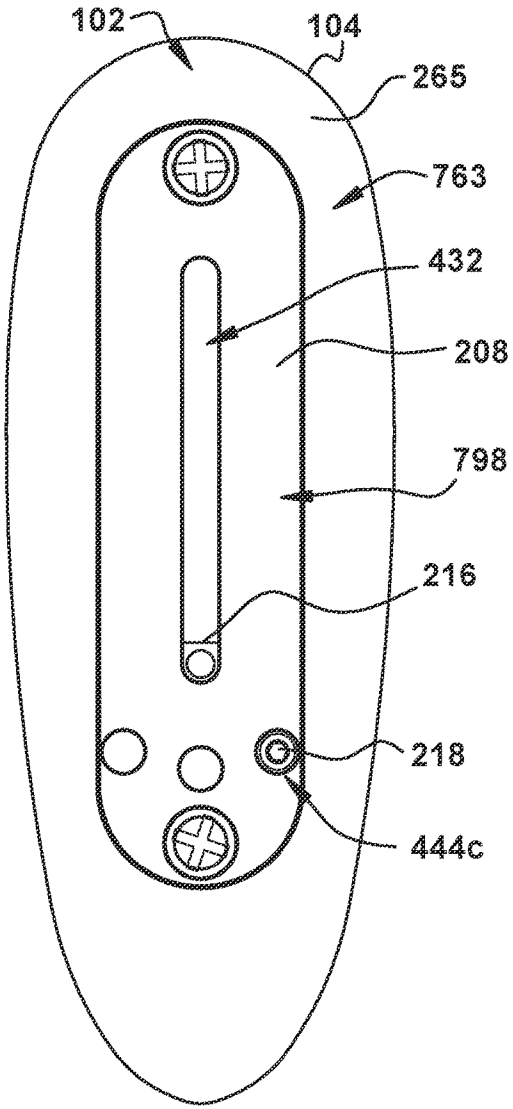
FIG. 2 is a partial rear view of the assembly of FIG. 1.

With the pad plate 310' is coupled to the base plate 208' and the adjustment fastener 322' is in the unclamped state, the pad plate 310' can be selectively adjusted relative to the base plate 208' and the buttstock 104' via transverse, lateral, and/or rotational movements of the pad plate 310' in a similar manner to that in which the pad plate 310 of FIGS. 1-12 is adjustable relative to the base plate 208 of FIGS. 1-2, with some example differences being described below.

The transverse, lateral, and/or rotational adjustment of the pad plate 310' may be limited by the first adjustment nut 218', the second adjustment nut 1520, and the guide pin 216'. For example, as shown in FIGS. 16A-16B, the pad plate 310' may be moved/slid in the transverse direction from a starting position (FIG. 16A) relative to the base plate 208'. The second adjustment nut 1520 and the adjustment fastener 322' are responsively slid in the transverse direction by the transversely moving pad plate 310'. Contact between the first adjustment nut 218' and the transverse ends 1542*a*, 1542*b'* of the base guide wall 1538 and/or the transverse ends 436*a'*, 436*b'* of the base slot 432' may provide a limit for the transverse movement of the pad plate 310'.

As shown in FIGS. 16B-16C, when the guide pin 216' is located in the lateral guide track portion 466', the pad plate 310' may be moved/slid in the lateral direction from a starting position (FIG. 16B) relative to the base plate 208'. The second adjustment nut 1520 and the adjustment fastener 322' are responsively slid in the lateral direction along the pad slot 454' and the pad depression 1552 by the laterally moving pad plate 310'. Contact between the second adjustment nut 1520 and the lateral ends 458*a'*, 458*b'* of the pad slot 454' and/or the lateral ends 1562*a*, 1562*b* of the pad depression 1552 may selectively limit the lateral movement of the pad plate 310'.

Figure 16E:
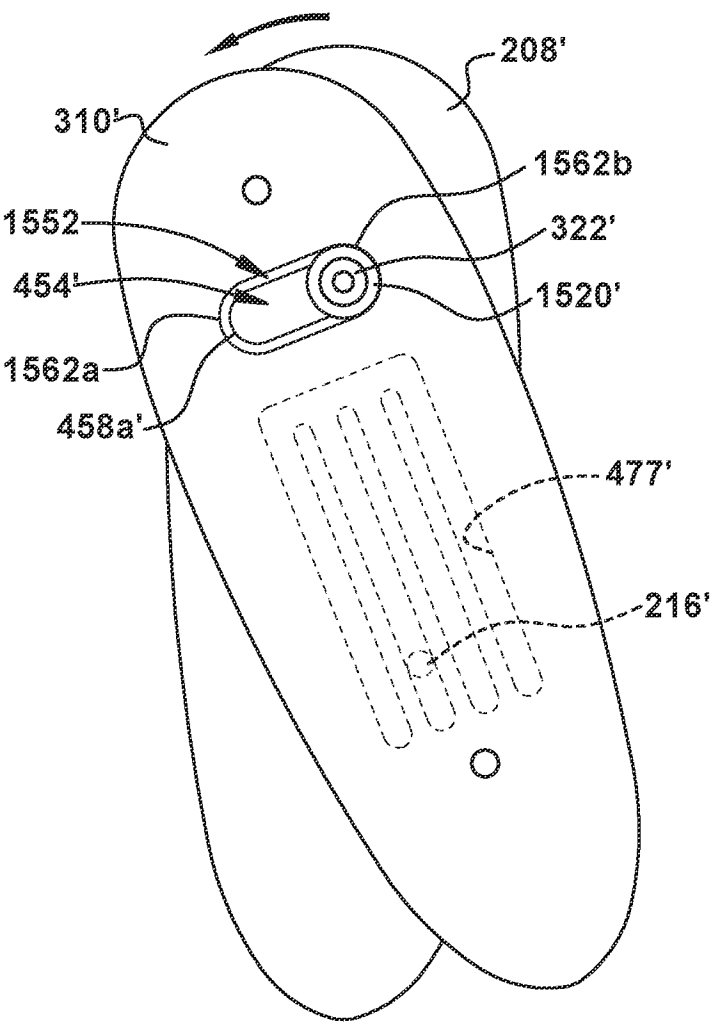
Figure 16D:
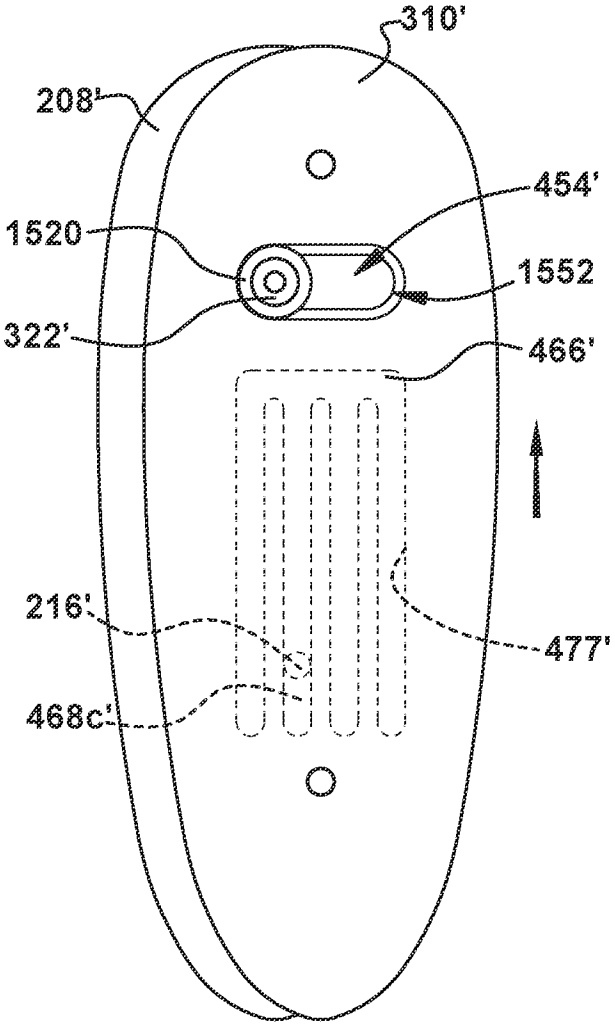

As shown in FIGS. 16D-16E, the pad plate 310' may also be rotated with respect to the base plate 208' (and thus the buttstock 104'). For example, the pad plate 310' may be rotated in a clockwise or counterclockwise direction about the guide pin 216' from a starting position (FIG. 16D) relative to the base plate 208'. Contact between the second adjustment nut 1520 and the lateral ends 458*a'*, 458*b'* of the pad slot 454' and/or the lateral ends 1562*a*, 1562*b* of the pad depression 1552 provides a limit for the rotation of the pad plate 310'.

Once a desired or predetermined orientation of the pad plate 310' has been achieved, the adjustment fastener 322' may be manipulated (e.g., rotated) into the clamped condition to substantially prevent the pad plate 310' from undesirably egressing from the desired orientation. The geometry of, and/or the materials forming, at least one of the adjustment fastener 322', the first the first adjustment nut 218', and the second adjustment nut 1520 may at least partially prevent the adjustment fastener 322' from being overtightened after reaching the clamped condition.

Referring back to FIGS. 14-15B, with the base plate 208' fixed on the buttstock 104' and the pad plate 310' secured on the base plate 208', the pad 112' can be selectively affixed to the pad plate 310'. For example, the pad 112' may be joined to the pad plate 310' such that the rear face 472*b'* of the pad 112' contacts the front face 446*a'* of the pad plate 310' and the second adjustment nut 1520 is positioned between the pad 112' and the pad plate 310'. The pad 112' is positioned on the pad plate 310' such that the first and second attachment holes 476*a'*, 476*b'* of the pad 112' are aligned with the first and second attachment holes 450*a'*, 450*b'* of the pad plate 310'. The fasteners 414*c'*, 414*d'* are passed through the first and second attachment holes 467*a'*, 476*b'* of the pad 112', and then threadably engaged with the first and second attachment holes 450*a'*, 450*b'* of the pad plate 310'. This engagement secures the pad 112' on the pad plate 310', and thus indirectly couples the pad 112' to the firearm 106'.

When provided, the adjustment hole 478' of the pad 112' may be aligned with the adjustment fastener 322'. This alignment allows the user to access the adjustment fastener 322' even after the pad 112' has been secured to the pad plate 310'. Therefore, via the adjustment hole 478', the user may adjust the orientation of the pad plate 310' (and thus the pad 112') when the pad 112' is detached from the pad plate 310' and when the pad 112' is attached to the pad plate 310'. However, it is contemplated that, in certain configurations, the adjustment hole 478' may be omitted from the pad 112' so that the orientation of the pad plate 310' may be adjusted only when the pad 112' is detached from the pad plate 310'.

Although the pad plate 310' and the pad 112' have been shown and described as being separate pieces, it is contemplated that pad plate 310' may be wholly or at least a portion integrally formed with the pad 112' as a single monolithic piece. This contemplated configuration is also applicable to the pad plate 310 and pad 112 of FIGS. 1-12.

Figure 17:
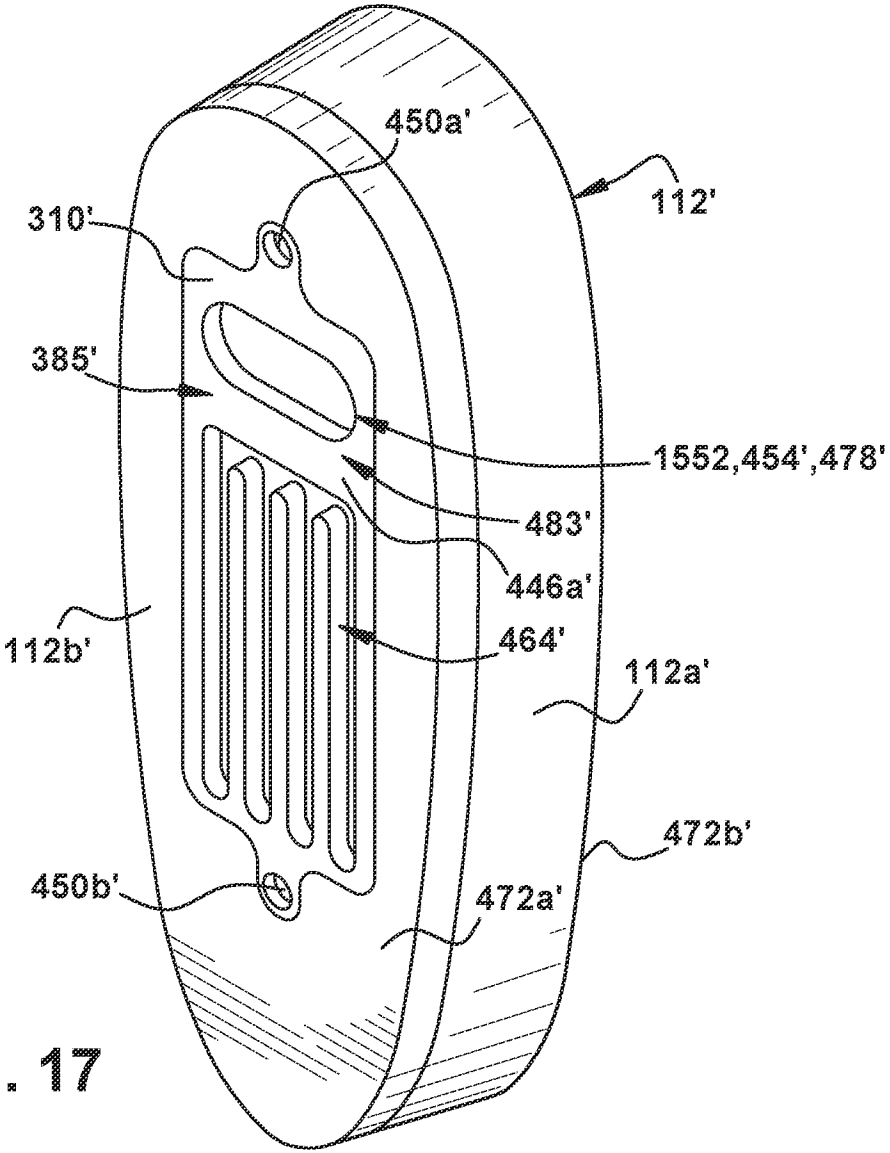
FIG. 17 is a partial perspective front view of another example configuration of the assembly of FIG. 14.

As another example, as shown in FIG. 17, the pad plate 310' may be in the form of an insert that is selectively or substantially permanently inserted into a correspondingly shaped pad depression 483' of the pad 112', similar to that of the pad plate 310 of FIGS. 1-12 The pad depression 483' may be shaped to not only selectively receive the insert pad plate 310', but also to selectively receive (and permit selective movement of) the second adjustment nut 1520 and the attachment fastener 322' between the insert pad plate 310 and the pad 112'.

The pad 112' of the configuration of FIG. 17 may also include the adjustment hole 478' so that the user may access the adjustment fastener 322' even after the insert pad plate 310' has been received in the pad depression 483'. However, it is contemplated that, in certain configurations, the adjustment hole 478' may be omitted from the pad 112' so that the orientation of the pad 112' and insert pad plate 310' combination may be adjusted only when the insert pad plate 310' is removed from the pad depression 483'.

Although the base plate 208' and the buttstock 104' have been shown and described as being separate pieces, it is contemplated that base plate 208' may be wholly or at least a portion integrally formed with the buttstock 104' as a single monolithic piece. This contemplated configuration is also applicable to the base plate 208 and buttstock 104 of FIGS. 1-12.

Figure 18:
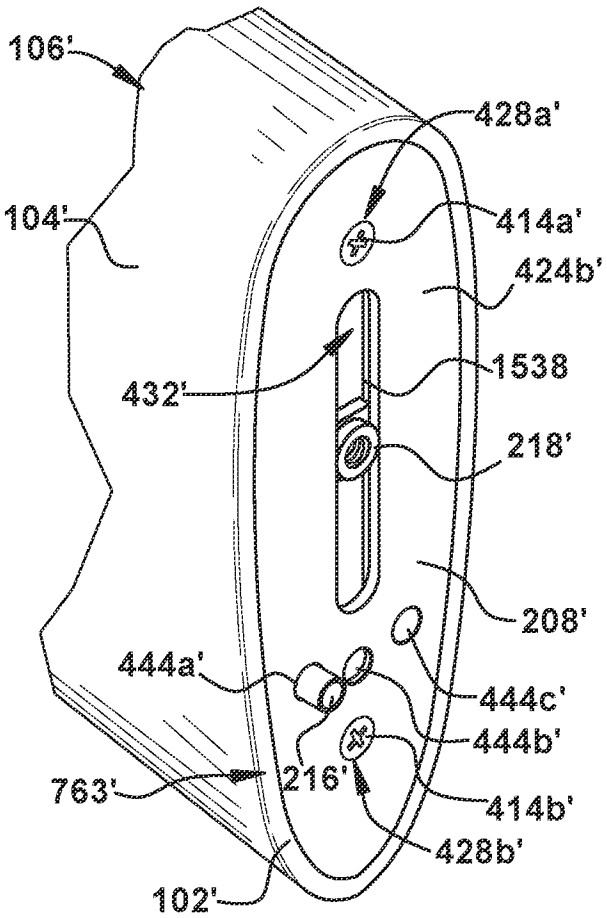
FIG. 18 is a partial perspective rear view of another example configuration of the assembly of FIG. 14.

As another example, as shown in FIG. 18, the base plate 208' may be in the form of an insert that is selectively or substantially permanently inserted at least partially into a correspondingly shaped buttstock depression 798', similar to that of the base plate 208 of FIGS. 1-12. The buttstock depression 798' thus may be shaped to not only selectively receive the base guide wall 1538, but also to selectively receive the insert base plate 208'. Furthermore, the buttstock depression 798' may also be configured to selective receive (and permit selective movement of) the first adjustment nut 218' between the insert base plate 208' and the buttstock 104'.

Although the guide pins 216, 216' of the assemblies 100, 100' have been described as being selectively engaged to a selected pin aperture 444*a-c*, 444*a'*-c' via threading or a press- and/or frictional-fit, at least one of the guide pins 216, 216' may alternatively or additionally be selectively engaged to a selected pin aperture 444*a-c*, 444*a'*-c' via welding, brazing, gluing, riveting, soldering, magnetism, any other suitable engagement mechanism, or any combination thereof.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. A "predetermined" status may be determined at any time before the structures being manipulated actually reach that status, the "predetermination" being made as late as immediately before the structure achieves the predetermined status. The term "substantially" is used herein to indicate a quality that is largely, but not necessarily wholly, that which is specified—a "substantial" quality admits of the potential for some relatively minor inclusion of a non-quality item. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

We claim:

1. An adjustable firearm butt assembly, comprising:

a base plate selectively attached to a buttstock of a firearm, the base plate having a base slot;

an adjustment nut aligned with, and transversely movable relative to, the base slot;

a pad plate selectively attached to the base plate with the base plate being interposed longitudinally between the pad plate and the adjustment nut, the pad plate having a plate slot and a guide track, the plate slot being aligned with both the adjustment nut and the base slot;

a guide pin having a portion selectively received in the guide track; and an attachment fastener selectively extending through the plate slot and into engagement with the adjustment nut to selectively attach the pad plate to the base plate, the attachment fastener being laterally movable with respect to the plate slot, and the attachment fastener being selectively movable between unclamped and clamped conditions via engagement with the adjustment nut;

wherein the pad plate is selectively movable relative to the base plate and the guide pin when the attachment fastener is in the unclamped condition, the guide pin sliding along the guide track responsive to movement of the pad plate relative to the base plate and the guide pin; and wherein the pad plate is substantially prevented from moving relative to the base plate when the attachment fastener is in the clamped condition, contact between the guide pin and a track wall of the guide track at least partially restricting the movement of the pad plate relative to the base plate when the attachment fastener is in the clamped condition.

2. The assembly of claim 1, further comprising an elastically deformable spring plate selectively interposed longitudinally between the buttstock and the base plate, the spring plate having transversely spaced first and second spring ends, the first spring end being selectively secured to the base plate such that the second spring end is pivotable relative to the first spring end and the base plate, the second spring end having at least one pin aperture in which the guide shank of the guide pin is selectively engaged;

wherein a portion of the guide pin applies a first longitudinal compressive force to a portion of the track wall when the second spring end is selectively pivoted longitudinally toward the buttstock.

3. The assembly of claim 2, wherein the track wall includes a track groove at least partially defining a track projecting portion;

the guide pin includes a guide head and a guide shank extending longitudinally from the guide head, the guide head having a head groove defining a head projecting portion, the head projecting portion being selectively received in the track groove and the track projection portion being selectively received in the head groove of the guide pin; and the head projecting portion of the guide pin applies the first longitudinal compressive force to track projection portion of the track wall when the second spring end of the spring plate is selectively pivoted longitudinally toward the buttstock.

4. The assembly of claim 2, wherein, when the attachment fastener is in the clamped condition, the second end of the spring plate is maintained in a pivoted condition via the adjustment fastener so that the guide pin applies the first longitudinal compressive force to the track wall of the pad plate;

the adjustment fastener applies a second longitudinal compressive force to the pad plate; and the first and second longitudinal compressive forces cooperatively urge the pad plate toward the base plate such that the pad plate is substantially prevented from undesirably moving relative to the base plate.

5. The assembly of claim 2, wherein the base plate is interposed longitudinally between the spring plate and the pad plate;

the spring plate includes at least one pin projection having a corresponding pin aperture formed therein, the at least one pin projection selectively extending longitudinally into a corresponding projection aperture of the base plate; and a guide shank of the guide pin is selectively engaged in the at least one pin aperture and a guide head of the guide pin is selectively received in the guide track.

6. The assembly of claim 2, wherein the spring plate and the base plate are selectively inserted at least partially into a buttstock depression of the buttstock, the buttstock depression extending longitudinally inward into the buttstock from a longitudinal end surface of the buttstock.

7. The assembly of claim 6, wherein the base plate includes transversely spaced first and second base ends and a first foot located at the first foot end, the first foot having a first free foot end;

the spring plate includes a second foot located at the first spring end, the second foot having a second free foot end, the first spring end being selectively secured to the first base end of the base plate; and when the base and spring plates are inserted into the buttstock depression and the spring plate is in an unflexed condition, the first and second free foot ends each directly contacting a depression end surface of the buttstock depression and at least the second spring end of the spring plate being longitudinally spaced from the depression end surface, a longitudinal distance between the second spring end of the unflexed spring plate and the depression end surface defining a maximum extent at which the second spring end may be pivoted longitudinally toward the buttstock.

8. The assembly of claim 1, wherein the guide track includes at least one lateral guide track portion and a plurality of transverse guide track portions extending transversely from the at least one lateral guide track portion such that the transverse guide track portions are in mutual fluid communication via the at least one lateral guide track portion, the transverse guide track portions being separated from one another in a lateral direction, the guide pin being selectively moved laterally from one transverse guide portion to another transverse guide portion via the at least one lateral guide track portion.

9. The assembly of claim 8, wherein, when the attachment fastener is in the unclamped condition, the pad plate is selectively moved transversely relative to the base plate when the guide pin is located in a selected one of the plurality of transverse guide track portions; and the pad plate is selectively moved laterally relative to the base plate when the guide pin is located in the at least one lateral guide track portion.

10. The assembly of claim 9, wherein the pad plate is rotatable about the guide pin relative to the base plate when the attachment fastener is in the unclamped condition, contact between the adjustment fastener and lateral ends of the pad slot limiting the rotation of the pad plate about the guide pin.

11. The assembly of claim 1, wherein the plate slot is elongate and has a longest dimension oriented in a lateral direction, the base slot is elongate and having a longest dimension oriented in a transverse direction, the lateral and transverse directions are perpendicular to one another, and both of the lateral and transverse directions are perpendicular to the longitudinal direction.

12. The assembly of claim 1, wherein the base plate includes a base depression formed around the base slot, the adjustment nut being selectively inserted into the base depression with lateral sides of the adjustment nut are adjacent to lateral sides of the base plate, the adjustment nut being limited in rotating by interaction of the lateral sides of the adjustment nut against the lateral sides of the base plate, the adjustment nut being selectively moved transversely along the base depression as the pad plate moves transversely relative to the base plate.

13. The assembly of claim 1, further comprising a pad configured to at least partially absorb and mitigate recoil forces of the firearm during use, the pad being selectively attached to the pad plate.

14. The assembly of claim 13, wherein the pad plate is selectively inserted at least partially into a pad depression of the pad.

15. The assembly of claim 14, wherein the pad depression includes a fastener receiving portion aligned with the plate slot when the pad plate is inserted into the pad, a portion of the adjustment fastener being received in the fastener receiving portion such that the received portion of the adjustment fastener may be positioned longitudinally between the pad and the inserted pad plate.

16. The assembly of claim 15, wherein the pad includes an adjustment hole extending longitudinally through an entirety of the pad, the adjustment hole extending longitudinally through the fastener receiving portion of the pad depression and being at least partially aligned with the plate slot when the pad is inserted in the pad plate, such that a portion of the adjustment fastener received in the fastener receiving portion is selectively accessible from a side of the pad located opposite the pad plate.

17. The assembly of claim 1, wherein the base plate and the adjustment nut are both at least partially located within a buttstock depression of the buttstock.

18. A method for customizing a firearm butt assembly for a user of a firearm, the method comprising:

providing the assembly of claim 1;

attaching the assembly to the buttstock of the firearm;

with the adjustment fastener in the unclamped condition, moving the pad plate relative to the base plate to place the pad plate in a predetermined orientation, the guide pin sliding along the guide track as the pad plate moves relative to the base plate; and with the pad plate in the predetermined orientation, manipulating the adjustment fastener to the clamped condition to substantially prevent the pad plate from moving relative to the base plate from the predetermined orientation, contact between the guide pin and the track wall of the guide track at least partially restricting the movement of the pad plate relative to the base plate when the attachment fastener is in the clamped condition.

19. The method of claim 17, wherein the assembly further comprises an elastically deformable spring plate selectively interposed longitudinally between the buttstock and the base plate, the spring plate having transversely spaced first and second spring ends, the first spring end being selectively secured to the base plate such that the second spring end is pivotable relative to the first spring end and the base plate, the second spring end having at least one pin aperture in which the guide shank of the guide pin is selectively engaged, the guide pin applying a first longitudinal compressive force to a portion of the track wall when the second spring end is selectively pivoted longitudinally toward the buttstock; and the adjustment fastener longitudinally pivots the second spring end toward the buttstock as the adjustment fastener is manipulated to the clamped condition such that in the clamped condition the second end of the spring plate is maintained in a pivoted condition via the adjustment fastener with the guide pin applying the first longitudinal compressive force to the track wall of the pad plate, the adjustment fastener applies a second longitudinal compressive force to the pad plate, and the first and second compressive forces cooperatively urge the pad plate toward the base plate such that the pad plate is substantially prevented from undesirably moving relative to the base plate.

20. The method of claim 18, wherein the track wall includes a track groove at least partially defining a track projecting portion, the guide pin includes a guide head and a guide shank extending longitudinally from the guide head, the guide head having a head groove defining a head projecting portion, the head projecting portion being selectively received in the track groove and the track projection portion being selectively received in the head groove of the guide pin, and the head projecting portion of the guide pin applies the first longitudinal compressive force to track projection portion of the track wall when the second spring end of the spring plate is selectively pivoted longitudinally toward the buttstock.

* * * * *